US009453511B2

(12) United States Patent
Quail

(10) Patent No.: US 9,453,511 B2
(45) Date of Patent: Sep. 27, 2016

(54) PUMP SYSTEM

(75) Inventor: Francis Quail, Stirlingshire (GB)

(73) Assignee: Quail Research and Design Limited, Stirlingshire, Great Britain (GB)

( * ) Notice: Subject to any disclaimer, the term of this patent is extended or adjusted under 35 U.S.C. 154(b) by 927 days.

(21) Appl. No.: 13/579,067

(22) PCT Filed: Feb. 17, 2011

(86) PCT No.: PCT/GB2011/000222
§ 371 (c)(1),
(2), (4) Date: Sep. 14, 2012

(87) PCT Pub. No.: WO2011/101636
PCT Pub. Date: Aug. 25, 2011

(65) Prior Publication Data

US 2012/0328412 A1 Dec. 27, 2012

(30) Foreign Application Priority Data

Feb. 18, 2010 (GB) ..... 1002766.2
Apr. 29, 2010 (GB) ..... 1007139.7

(51) Int. Cl.
*F04D 5/00* (2006.01)
*F04D 13/10* (2006.01)

(52) U.S. Cl.
CPC ..... *F04D 5/006* (2013.01); *F04D 13/10* (2013.01)

(58) Field of Classification Search
CPC ..... F04D 5/002–5/008; F04D 13/10; F04D 17/06; F04D 23/008
USPC ..... 415/55.5, 55.6, 55.7, 68
See application file for complete search history.

(56) References Cited

U.S. PATENT DOCUMENTS 1,510,107 A 9/1924 Rodriguez et al.
2,245,114 A 6/1941 Orleans
(Continued)

FOREIGN PATENT DOCUMENTS

DE 3209736 A1 10/1983
EP 0690233 A1 1/1996
(Continued)

OTHER PUBLICATIONS

International Search Report corresponding to International Application No. PCT/GB2011/000222 dated Jun. 14, 2011.
(Continued)

*Primary Examiner* — Richard Edgar
*Assistant Examiner* — Jesse Prager
(74) *Attorney, Agent, or Firm* — Myers Bigel & Sibley, P.A.

(57) ABSTRACT

A regenerative pump (100) comprises at least one pump unit (105), the at least one pump unit comprising a casing or housing (110) comprising a fluid passage channel (115); and at least one impeller (120) provided inside the casing or housing for pumping the fluid through the fluid passage channel, wherein the casing or housing comprises at least one inlet channel (130) and at least one outlet channel (140) in communication with the fluid passage channel, the at least one inlet channel and/or the at least one outlet channel each comprising a first or axial portion (134) at least partially and preferably substantially parallel to an axis of rotation of the at least one impeller. The pump can be arranged in a single stage or multistage configuration, and has improved weight/size ratio and performance characteristics.

16 Claims, 17 Drawing Sheets

(56) References Cited

U.S. PATENT DOCUMENTS

| | | | | |
|---|---|---|---|---|
| 4,854,830 | A | 8/1989 | Kozawa et al. | |
| 5,401,143 | A | 3/1995 | Yu | |
| 5,584,650 | A | 12/1996 | Redmond et al. | |
| 5,642,981 | A * | 7/1997 | Kato | F04D 29/188 415/55.1 |
| 5,807,068 | A | 9/1998 | Dobler et al. | |
| 7,063,502 | B2 * | 6/2006 | Honda | F04D 29/188 415/225 |
| 7,244,094 | B2 * | 7/2007 | Miura | F04D 29/669 415/106 |
| 2008/0050249 | A1 | 2/2008 | Geremia | |

FOREIGN PATENT DOCUMENTS

| | | | |
|---|---|---|---|
| EP | 0843099 | A2 | 5/1998 |
| EP | 1306555 | A2 | 5/2003 |
| GB | 2134598 | A | 8/1984 |
| GB | 2477178 | A | 7/2011 |
| JP | 2005127290 | A | 5/2005 |

OTHER PUBLICATIONS

Written Opinion of the International Searching Authority corresponding to International Application No. PCT/GB2011/000222.

Search Report corresponding to British Application No. GB1020490.7 dated Jan. 10, 2011.

First Office Action corresponding to Chinese Application No. 2011800193598 issued Oct. 22, 2014.

Examination Report corresponding to European Application No. 11708068.9 issued Dec. 1, 2015.

* cited by examiner

PUMP SYSTEM

RELATED APPLICATIONS

This application is a 35 U.S.C. §371 national stage application of PCT Application No. PCT/GB2011/000222, filed on Feb. 17, 2011, which claims priority from British Application No. 1002766.2 filed on Feb. 18, 2010 and claims priority from British Application No. 1007139.7 filed on Apr. 29, 2010, the contents of which are incorporated herein by reference in their entireties. The above-referenced PCT International Application was published as International Publication No. WO 2011/101636 A1 on Aug. 25, 2011.

FIELD OF INVENTION

This invention relates to an improved pump, and particularly, though not exclusively to a regenerative pump. This invention also relates to an improved impeller for use in a pump such as a velocity pump, e.g. in a regenerative pump. The invention also relates to the use of an improved pump such as regenerative pump in Electrical Submersible Pumps (ESPs), in oil pumps for, e.g. gas turbine engines, turbine gearboxes, in fuel pumps for, e.g. automotive vehicles, in industrial process applications, e.g. in pharmaceutical process manufacturing or petrochemical processes, and/or in water pumps, e.g. in mobile fire engines (also known as water tenders).

BACKGROUND TO INVENTION

Pumps are the single largest user of electricity in industry in the European Union, and of those pumps, centrifugal pumps represent approximately 73% of all pump types.

A centrifugal pump is a rotodynamic pump that uses a rotating impeller to increase the pressure of a fluid. In a centrifugal pump, the impeller—which typically carries between 4 and 8 vanes—rotates and increases the kinetic energy of the fluid that is being pumped. This kinetic energy is then converted into pressure energy by a stationary volute or diffuser.

The amount of energy given to the fluid is proportional to the velocity at the tip of the impeller. The faster the impeller rotates, then the higher will be the velocity of the fluid at the impeller tip and the greater the energy imparted to the liquid. The kinetic energy of the fluid discharged from the impeller is converted by creating a resistance to the flow. The first resistance is created by the pump volute that catches the fluid and slows it down. In the discharge region, the fluid further decelerates and its velocity is converted to pressure according to Bernoulli's principle. Therefore, the pressure (commonly referred to as 'head' when defined in terms of height of fluid) developed is approximately equal to the velocity energy at the periphery of the impeller.

Typically small, (less than 500 gpm capacity), centrifugal pumps are largely inefficient, due principally to the low velocity imparted to the fluid when such pumps are driven by commonly available drive means such as 1725 rpm and 3450 rpm (50 Hz-60 Hz) electric motors.

Like the centrifugal pump, the regenerative pump is a kinetic pump. However the regenerative pump can in many applications offer a more efficient alternative.

In a centrifugal pump, fluid only travels through a centrifugal impeller once. In contrast, in a regenerative pump, fluid travels many times through the vanes of the impeller. A regenerative pump uses an impeller with turbine-type blades mounted on the periphery running in an annular channel surrounding the periphery of the impeller hub. In a known design, the impeller has radial vanes machined into the impeller periphery and the fluid passes through an open annular channel and circulates repeatedly through the impeller vanes.

The suction region of the pump is separated from the discharge region by a barrier on the casing known as a 'stripper', creating a hydraulic seal between the high pressure and low pressure sides of the pump. The repeated fluid circulation during the flow process or 'multistaging' principally allows regenerative pumps to generate high heads at relatively low specific speeds. In spite of having operating characteristics that mimic a positive displacement pump, (including power directly proportional to head, with maximum power required at shutoff, and a steep head-capacity curve), the regenerative pump is a kinetic pump, i.e. kinetic energy is imparted to the fluid by the series of impulses given to the fluid by the rotating impeller blades. At inlet the fluid splits to both sides of the impeller and continuously circulates between the blades and the channel. When the circulation flow in the impeller and the peripheral flow in the channel unite the momentum exchange that takes places develops a helical or corkscrew fluid motion.

One of the main characteristic of regenerative pumps is the ability to generate high discharge pressures at low flowrates. A regenerative pump typically develops significantly higher heads than a centrifugal pump with comparable impeller size.

The regenerative pump is sometimes also referred to as a peripheral pump, turbulence pump, friction pump, turbine pump, drag pump, side channel pump, traction pump or vortex pump.

In applications requiring high performance, it may be advantageous to connect in series several regenerative pumps to provide a multistage regenerative pump. However, the configuration and efficiency of a multistage regenerative pump is dictated and limited by the manner in which the different units constituting the multistage assembly may be connected to each other. Typically, in a regenerative pump, the inlet and outlet which carry the fluid to and from the impeller region extend radially from an axis of rotation of the impeller. This imparts design and functional limitations on the resulting multistage assembly, not only in terms of configuration and size, but also in terms of performance, as kinetic energy may be lost during transfer of the fluid from the outlet of one pump unit to the inlet of another pump unit.

Therefore, the present invention has identified a need to provide a regenerative pump having improved weight/size ratio and/or performance characteristics, and which is particularly suitable as a multi-stage arrangement.

Examples of applications in which the use of improved regenerative pumps may be of particular significance include Electrical Submersible Pumps (ESPs) for oil recovery, oil pumps for gas turbine engines, and/or oil pumps for turbine gearboxes, e.g. wind turbine gearboxes.

During oil recovery from an oil well, the oil is initially driven to the surface by a number of natural mechanisms. This constitutes the primary recovery stage. These mechanisms include expansion of natural gas near the top of the reservoir, expansion of gas dissolved in the crude oil, gravity drainage within the reservoir and upward displacement of oil by natural water. However, the primary recovery stage typically provides a recovery factor of approximately 5-15% of the original oil.

When the underground pressure becomes insufficient to force the oil to the surface of the oil well, an increase in the recovery factor can be obtained by applying secondary recovery methods. These methods typically include injection of a fluid under pressure such as natural gas or water, or the use of Artificial Lift Systems (ALSs) such as Electrical Submersible Pumps (ESPs) which are inserted at the bottom of the well. The use of secondary recovery techniques typically increases the recovery factor to approximately 15-40%.

Existing ALSs are mainly based on legacy technology which is decades old and which constrains the performance. Conventional ESP arrangements can exceed 20 meters in length in typical hydraulic lift systems. An Artificial Lift System typically contains many components, including a down-hole high speed pump, a high speed motor, a monitoring package and packer; power, communications and hoisting cable; surface power drive and controls; and surface data distribution.

Existing down-hole pumps are, typically, centrifugal devices approximately 3½" in diameter rotating at approximately 3000 rpm. There is currently limited experience of high speed rotational pump design or relevant testing techniques.

Therefore, the present invention has identified a need for an improved pump for use in electrical submersible pumps, and of such dimensions so as to be capable of being inserted (or replaced) into the oil well without the need for recovering the production tubing.

In an aerospace gas turbine engine, oil pumps are vital to the efficient operation of the engine. Failure of the pumps necessitates a rapid shutdown of the engine. Conventional gas turbine oil pumps are positive displacement type pumps, i.e. they induce a small volume of oil into the inlet port, and transfer it to the outlet port by a rotating mechanism.

Positive displacement oil feed and scavenge pumps are extremely inefficient when the inlet is air-locked. Therefore it is important to ensure that the pump is capable of being primed with oil during engine start-up, and re-primed during any periods of oil interruption (e.g. negative 'g' flight manoeuvre, windmill relight). Gas turbine oil system pumps are normally used in recirculatory oil systems, i.e. comprising a combined feed (supply) and scavenge (return) oil loop. Pump elements of such positive displacement pumps are used both as pressure (feed) and scavenge (return) and are incorporated within a common casing. The oil pump pack is driven by an accessory drive system. As the feed oil is distributed to all the lubricated parts of the engine a substantial amount of sealing air mixes with it and increases its volume. Additionally, the bearing chambers operate under differing pressures. Therefore, to prevent flooding, each chamber is typically provided with a scavenge pump. The oil flowing through the feed pump normally has a very low air content, whereas the scavenge pumps have to pump oil which has a high air content. This invariably means that the scavenge pumps are more sensitive to priming problems.

Therefore, the present invention has identified is a need for a regenerative pump, particularly a multiple stage regenerative pump, which is capable of application in a engine oil pump, e.g. a gas turbine engine oil pump or an automotive engine oil pump, and which can be operated in both directions to facilitate a pressure (feed) or scavenge (return) lubrication system.

In a wind turbine, gears typically connect a low-speed turbine blade shaft to a high-speed generator shaft. Rotational speeds increase typically from about 30 to 60 rotations per minute (rpm) to about 1000 to 1800 rpm which are required by most generators to produce electricity. This power transfer is conventionally carried out through the use of gearbox. The gearbox is an onerous and heavy part of the wind turbine which requires lubrication. Typically, lubrication is performed using positive displacement oil pumps similar to the oil pumps used in gas turbine engine oil systems.

Therefore, the present invention has identified is a need for a regenerative pump, particularly a multiple stage regenerative pump, which is capable of application in a gearbox oil system, e.g. a wind turbine gearbox oil system, and which can be operated in both directions to facilitate a pressure (feed) or scavenge (return) lubrication system.

Fuel pumps for use in, e.g. automotive engines, can be of various designs. There is a need for a pump suitable for use in fuel pumps, e.g. in automotive engine fuel pumps, having improved weight/size ratio and/or performance characteristics.

Process manufacturing for, e.g. the pharmaceutical industries, typically involves pumping fluid(s) reacting in or produced by the pharmaceutical process. Similarly, process manufacturing in, e.g. the petrochemical industry, typically involves pumping petrochemical substances, e.g. reacting in or produced by a petrochemical process. There is a need for a pump suitable for use in process manufacturing, having improved weight/size ratio and/or performance characteristics.

Water pumps, e.g. for use in fire engines or water tenders, typically require high performance pumps capable of delivering large water output under high pressure. There is a need for a pump suitable for use in high performance water pumps such as water pumps used in fire engines, having improved weight/size ratio and/or performance characteristics.

It is an object of at least one embodiment of at least one aspect of the present invention to obviate and/or mitigate one or more disadvantages in the prior art.

It is an object of at least one embodiment of at least one aspect of the present invention to provide a regenerative pump having improved weight/size ratio and/or performance characteristics.

It is an object of at least one embodiment of at least one aspect of the present invention to provide a multistage regenerative pump having optimised weight/size ratio and/or performance characteristics.

It is an object of at least one embodiment of at least one aspect of the present invention to provide an improved impeller for use in a velocity pump, e.g. a multistage regenerative pump.

It is an object of at least one embodiment of at least one aspect of the present invention to provide a casing for use in a velocity pump, e.g. a multistage regenerative pump.

SUMMARY OF INVENTION

According to a first aspect of the present invention there is provided a pump, such as a regenerative pump, the pump comprising at least one pump unit, the at least one pump unit comprising a casing or housing comprising a fluid channel or fluid passage channel; and at least one impeller provided inside the casing for pumping the fluid through the fluid channel or fluid passage channel, wherein the casing or housing comprises at least one inlet channel and at least one outlet channel in communication with the fluid channel or fluid passage channel, the at least one inlet channel and/or the at least one outlet channel each comprising a first or axial portion at least partially and preferably substantially parallel to an axis of rotation of the at least one impeller.

The terms "axial" and/or "substantially parallel" is not to be understood literally, but will be understood herein as extending in a direction at an angle in the region of 0-45°, preferably 0-30°, more preferably 0-15° relative to an axis of rotation of the at least one impeller.

The at least one inlet channel and/or the at least one outlet channel may be peripheral to the fluid passage channel and/or the casing or housing.

The at least one inlet channel and/or the at least one outlet channel may comprise a second portion extending from the fluid passage channel in a plane at least partially and preferably substantially perpendicular to an axis of rotation of the impeller.

The second portion may be substantially radial relative to an axis of rotation of the at least one impeller.

Alternatively, the second portion may extend from the fluid passage channel in a direction not passing through an axis of rotation of the at least one impeller.

Advantageously, the second portion may extend from the fluid passage channel in a direction at least partially and typically substantially tangential to a direction of fluid flow with the fluid passage channel or to a direction of rotation of the at least one impeller.

The second portion may extend from the fluid passage channel in a direction at least partially and typically substantially tangential to a continuous fluid flow between the second portion and the fluid passage channel. By such provision the flow of a fluid into and/or out of the fluid passage channel may be improved, e.g. reduction in fluid pressure on entry into/exit from the fluid passage channel may be minimised by provision of a smooth guidance between the fluid passage channel and the second portion of the at least one inlet and/or outlet channel. Thus, the efficiency of the pump may be enhanced.

Typically the second portion of the at least one inlet and/or outlet channel may extend from the fluid passage channel in a plane at least partially and preferably substantially perpendicular to an axis of rotation of the impeller, in a direction at an angle in the range of 0° (substantially tangential to a continuous fluid flow between the second portion and the fluid passage channel) to 90° (radial).

Preferably, the first or axial portion and the second portion of the at least one inlet and/or outlet channel may be in communication with one another and/or may be connected by e.g. at least one curved portion. By such provision the flow of a fluid through the at least one inlet and/or outlet channel may be improved, e.g. reduction in fluid pressure through the at least one inlet and/or outlet channel may be minimised by provision of a smooth guidance between the first or axial portion and the second portion of the at least one inlet and/or outlet channel. Thus, the efficiency of the pump may be enhanced.

Advantageously, the first, second, and/or at least one curved portion of the at least one inlet and/or outlet channel may be substantially tubular and/or substantially circular in cross-section.

Alternatively, the first, second, and/or at least one curved portion of the at least one inlet and/or outlet channel may be substantially non-circular in cross-section, e.g. oval, elliptic, or any other suitable optimised profile.

The first, second, and/or at least one curved portion of the at least one inlet and/or outlet channel may have a diameter in the range of 1-100 mm, and typically in the range of 5-50 mm.

Conveniently, the casing may be provided with a barrier or stripper separating a fluid passage channel portion near the at least one inlet channel from a fluid passage channel portion near the at least one outlet channel. By such provision a hydraulic seal may be provided or created between high pressure and low pressure regions of the at least one pump unit.

The dimension of the barrier or stripper may be in the range of 10-100°, preferably 20-50°, typically approximately 30° between or relative to the inlet and outlet portions of the fluid passage channel.

The at least one impeller may comprise a frame, and a plurality of vanes extending outwardly from a periphery of the frame.

The vanes may be equally spaced from each other.

Typically, the at least one impeller may comprise a number of vanes in the range of 10-60, preferably in the range of 20-50, preferably approximately 30.

The frame may comprise a hub portion connected to a shaft at or near a substantially central portion of the frame.

The diameter of the hub portion may be in the range of 5-800 mm, and typically in the range of 10-400 mm.

The frame may further comprise a flanged portion near a periphery of the frame.

Typically, the vanes may extend outwardly from a periphery of the hub portion.

The vanes may extend outwardly from a periphery of the hub portion beyond the periphery of the flanged portion.

Alternatively, the vanes may extend outwardly from a periphery of the hub portion and may be substantially flush with the periphery of the flanged portion.

Alternatively, the vanes may extend outwardly from a periphery of the hub portion inside or within the periphery of the flanged portion.

Typically, the vanes may extend substantially radially from a periphery of the hub portion.

Alternatively, the vanes may extend at an angle from a periphery of the hub portion, e.g. at an inclination of 0°-60° from the radial position in a forward or rearward attitude.

The vanes may comprise a first side and a second side.

The first and/or second sides may be substantially flat or planar.

Alternatively, the vanes may be profiled and may comprise, e.g. aerofoil, twist and/or other profile configurations.

The tip of substantially diametrically opposite vanes may define an outer vane tip diameter.

The outer vane tip diameter may be in the range of 10-1000 mm, and typically in the range of 50-500 mm.

The vanes may have a substantially uniform thickness across their length.

Alternatively, the vanes may have a variable thickness across their length.

The thickness of the vanes may be in the range of 0.2-20 mm, and typically in the range of 0.5-5 mm.

Typically, the at least one pump unit may comprise one impeller.

The fluid passage channel may be in the form of a conduit having a depth and a height.

The conduit may be substantially circular in cross-section.

Alternatively, the conduit may be substantially non-circular in cross-section, and may have a depth/height aspect ratio in the range of 0.4-1.2, and typically in the range of 0.6-1.

Advantageously, the pump may comprise a plurality of pump units. By such provision the pump may be defined as a multistage pump.

At least one and preferably each of the plurality of pump units may be in contact with, e.g. abut, at least one adjacent pump unit.

At least one and preferably each of the plurality of pump units may be sealably connectable, preferably axially sealably connectable, to at least one adjacent pump unit, e.g. by connection means such as thread and screws, bolts, clips or the like.

Alternatively, at least one and preferably each of the plurality of pump units may be sealably connected, preferably axially sealably connected, to at least one adjacent pump unit, e.g. by casting or moulding.

Typically, the plurality of pump units may be arranged in series.

Preferably, each pump unit may comprise one inlet channel and one outlet channel.

The plurality of pump units may comprise a first end or feed pump unit and a second end or discharge pump unit.

Conveniently, the inlet channel of the first end or feed pump unit may be connected to a fluid supply.

The outlet channel of the first end or feed pump unit may be connected to the inlet channel of an adjacent pump unit.

Conveniently, the outlet channel of the second end or discharge pump unit may be connected to a fluid discharge system.

The inlet channel of the second end or discharge pump unit may be connected to the outlet channel of an adjacent pump unit.

The plurality of pump units may further comprise one or more intermediate pump units.

Typically, the inlet channel of each intermediate pump unit may be connected to the outlet channel of the first end or feed pump unit or to the outlet channel of an adjacent intermediate pump unit.

Typically also, the outlet channel of each intermediate pump unit may be connected to the inlet channel of the second end or discharge pump unit or to the inlet channel of an adjacent intermediate pump unit.

At least the outlet channel of the first end or feed pump unit, both the inlet channel and the outlet channel of each intermediate pump unit, and at least the inlet channel of the second end or discharge pump unit, may comprise a first or axial portion substantially parallel to an axis of rotation of the at least one impeller.

Both the inlet channel and the outlet channel of each intermediate pump unit may comprise a first or axial portion substantially parallel to an axis of rotation of the at least one impeller.

In one embodiment, both the inlet channel and the outlet channel of each pump unit may comprise a first or axial portion substantially parallel to an axis of rotation of the at least one impeller.

In an alternative embodiment, the outlet channel of, e.g. the second end or discharge pump unit, may not comprise a first or axial portion or a curved portion, i.e. may only comprise a second portion extending from the fluid passage channel in a plane at least partially and preferably substantially perpendicular to an axis of rotation of the impeller, e.g. substantially radial. By such provision, the pump, e.g. the regenerative pump, may be arranged to have a substantially axial inlet at a first end of feed end, and an outlet substantially perpendicular to an axis of rotation of the impeller, e.g. a radial outlet, at a second end or discharge end. This may advantageously allow such pump to be used or inserted in an existing assembly having similar feed and discharge configuration, e.g. to replace the pump unit of a centrifugal pump assembly without requiring replacement of the casing or shell, while improving performance of the pump by using a pump according to the present invention.

Alternatively, or additionally, the inlet channel of, e.g. the first end or feed pump unit, may not comprise a first or axial portion or a curved portion, i.e. may only comprise a second portion extending from the fluid passage channel in a plane at least partially and preferably substantially perpendicular to an axis of rotation of the impeller.

In an arrangement comprising one pump unit, e.g. a single stage pump, the first or axial portions of the at least one inlet channel and at least one outlet channel may be aligned at least partially and substantially parallel to the axis of rotation of the impellers and/or share a common axis substantially parallel to the axis of rotation of the impellers.

In an alternative embodiment of a single stage pump, the at least one inlet channel may comprise a first or axial portion at least partially and preferably substantially parallel to an axis of rotation of the at least one impeller, and the at least one outlet channel may not comprise a first or axial portion or a curved portion, i.e. may only comprise a second portion extending from the fluid passage channel in a plane at least partially and preferably substantially perpendicular to an axis of rotation of the impeller. By such provision, the pump, e.g. the regenerative pump, may be arranged to have a substantially axial inlet at a first end of feed end, and an outlet substantially perpendicular to an axis of rotation of the impeller, e.g. a radial outlet, at a second end or discharge end. This may advantageously allow such pump to be used or inserted in an existing assembly having similar feed and discharge configuration, e.g. to replace the pump unit of a centrifugal pump assembly without requiring replacement of the casing or shell, while improving performance of the pump by using a pump according to the present invention.

In an alternative embodiment of a single stage pump, the at least one outlet channel may comprise a first or axial portion at least partially and preferably substantially parallel to an axis of rotation of the at least one impeller, and the at least one inlet channel may not comprise a first or axial portion or a curved portion, i.e. may only comprise a second portion extending from the fluid passage channel in a plane at least partially and preferably substantially perpendicular to an axis of rotation of the impeller.

Conveniently, the connection between an inlet channel of a pump unit and an outlet channel of an adjacent pump unit may be provided through their respective first or axial portions.

The first or axial portions of at least the outlet channel of the first end or feed pump unit, at least the inlet channel of the second end or discharge pump unit, and optionally both the inlet channel and the outlet channel of each of one or more intermediate pump units, may be at least partially aligned and may be substantially parallel to the axis of rotation of the impellers and/or may share a common axis substantially parallel to the axis of rotation of the impellers.

Typically, the first or axial portions of the inlet and outlet channels of each of the plurality of pump units may be aligned substantially parallel to the axis of rotation of the impellers and/or share a common axis substantially parallel to the axis of rotation of the impellers. The phrase "substantially parallel" will be understood herein as extending in a direction at an angle in the region of 0-45°, preferably 0-30°, more preferably 0-15° relative to an axis of rotation of the at least one impeller.

Advantageously, the plurality of pump units may be configured to have a common centreline, e.g. such that the impellers of the plurality of pump units share a common axis of rotation. By such provision, the plurality of pump units may be configured to optimise the compactness of the pump.

Advantageously, the impellers of the plurality of pump units may be connected to a drive shaft.

Conveniently, the drive shaft and the impellers of the plurality of pump units may share a common axis of rotation.

The diameter of the shaft may be in the range of 10-90% of the hub portion diameter.

It is to be understood that the diameter of the hub relative to the diameter of the hub portion may vary depending on the application envisaged for the pump. In applications requiring a multistage pump comprising a low number of pump units, such as oil pumps for, e.g. gas turbine engines or turbine gearboxes, the diameter of the shaft relative to the diameter of the hub portion may be relatively small so as to minimise the overall weight of the pump. In contrast, in applications requiring a multistage pump comprising a high number of pump units, such as electrical submersible pumps for, e.g. oil and gas recovery, the diameter of the shaft relative to the diameter of the hub portion may be relatively high so as to be capable of withstanding high mechanical constraints, e.g. torsion strength, imparted to the shaft by the driving of a high number of pump units. Therefore, the dimension of the shaft relative to the dimension of the hub portion may be adapted to suit particular applications, without the need to alter the dimension of the impeller itself, casing, or the overall dimension of the pump, thus not affecting the performance and efficiency of the pump.

Typically, the pump may comprise at least two, e.g. two to three hundred pumps units, or more. It is to be understood that the number of pump units selected in a multistage regenerative pump may depend on the type of application envisaged for the pump.

The casing may comprise one or more casing units.

Preferably, the casing may comprise a plurality of casing units.

Each of the plurality of casing units may comprise a first side facing toward a feed end of the pump, and a second side or axially partitioned casing facing toward a discharge end of the pump.

The plurality of casing units may comprise a first end or feed casing unit and a second end or discharge casing unit.

The first side of the first end or feed casing unit may be substantially solid, and may comprise an aperture connected to the at least one inlet channel of the first end or feed pump unit.

The second side of the first end or feed casing unit may be connected, e.g. sealably connected, to and/or may be in abutment with the first side of an adjacent casing unit.

The second side of the first end or feed casing unit may comprise part of the fluid passage channel of a first end or feed pump unit.

The first side of the second end or discharge casing unit may be connected, e.g. sealably connected, to and/or may be in abutment with the second side an adjacent casing unit.

The first side of the second end or discharge casing unit may comprise part of the fluid passage channel of a second end or discharge pump unit.

The second side of the second end or discharge casing unit may be substantially solid, and may comprise an aperture connected to the at least one outlet channel of the second end or discharge pump unit.

The plurality of casing units may further comprise at least one intermediate casing unit.

Typically, the first side of the at least one intermediate casing unit may be connected, e.g. sealably connected, to and/or may be in abutment with the second side of the first end or feed casing unit or to the second side of an adjacent intermediate casing unit.

Typically also, the second side of the at least one intermediate casing unit may be connected, e.g. sealably connected, to and/or may be in abutment with the first side of the second end or discharge casing unit or to the first side of an adjacent intermediate casing unit.

Typically, the first side of a casing unit may be connected, e.g. sealably connected, to and/or may be in abutment with the second side of an adjacent casing unit by conventional fixing means, e.g. thread and screws, clips or the like.

The first side of an intermediate casing unit may comprise part of the fluid passage channel of a pump unit, and the second side of said intermediate casing unit may comprise part of the fluid passage channel of an adjacent pump unit.

Conveniently, a pump unit may be formed by providing at least one impeller between the first side of a casing unit and the second side of an adjacent casing unit.

Advantageously, the first side of a casing unit and the second side of an adjacent casing unit may complement one another so as to form the fluid passage channel of the corresponding pump unit.

Advantageously also, the first side of a casing unit and the second side of an adjacent casing unit may complement one another so as to form the second portion of the at least one inlet and/or outlet channel of the corresponding pump unit.

The first side of a casing unit and the second side of an adjacent casing unit may complement one another so as to further form the curved portion of the at least one inlet and/or outlet channel of the corresponding pump unit.

Alternatively, the curved portion of the at least one inlet and/or outlet channel of the corresponding pump unit may be provided within at least one of the adjacent casing units.

Preferably, the first or axial portion of the at least one inlet and/or outlet channel of the corresponding pump unit may be provided within at least one of the adjacent casing units.

Typically, the first or axial portion of the at least one inlet and/or outlet channel of the corresponding pump unit may be partially and preferably substantially parallel to an axis of rotation of the at least one impeller and/or share a common axis substantially parallel to the axis of rotation of the at least one impeller.

Alternatively, when the at least one inlet and/or outlet channel do not comprise a second portion or a curved portion, e.g. only comprise a first or axial portion, the first or axial portion of the at least one inlet and/or outlet channel may be provided at an angle relative to the axis of rotation of the at least one impeller to allow for connection of the first or axial portion of the at least one inlet channel of a pump unit with the first or axial portion of the at least one outlet channel of an adjacent pump unit. Typically, the first or axial portion of the at least one inlet and/or outlet channel may extend in a direction at an angle in the region of 0-45°, preferably 0-30°, more preferably 0-15° relative to an axis of rotation of the at least one impeller.

In an alternative embodiment, when the at least one inlet and/or outlet channel do not comprise a second portion or a curved portion, e.g. only comprise a first or axial portion, the connection between the at least one inlet channel of a pump unit and the at least one outlet channel of an adjacent pump unit may be provided through at least one connection portion connecting the first or axial portion of the at least one inlet channel of a pump unit with the first or axial portion of the at least one outlet channel of an adjacent pump unit.

The at least one connecting portion may be curved, or alternatively may extend at an angle relative to the axis of rotation of the impellers, e.g. at an angle in the region of 0-45°, preferably 0-30°, more preferably 0-15° relative to an axis of rotation of the at least one impeller.

Typically, each pump unit may comprise one inlet channel and one outlet channel.

Typically also, one impeller may be provided between the first side of a casing unit and the second side of an adjacent casing unit.

Typically, for a pump comprising N pump units, the corresponding number of casing units may equal N+1.

The at least one casing unit may have a diameter in the range of 20-1,500 mm, and typically in the range of 50-500 mm.

The at least one casing unit may have a thickness or height in the range of 10-1100 mm, and typically in the range of 50-550 mm.

The impeller may rotate clockwise and/or counter-clockwise.

Preferably, the impeller may be capable of being rotated clockwise and counter-clockwise. By such provision the pump may be used in a first or normal fluid direction and in a second or reverse fluid direction. This allows a user to reverse the direction in which a fluid is being pumped as required.

Typically, the pressure rise ratio between an outlet and an inlet of each of the at least one pump unit may be in the range of 1-100, and typically in the range of 1-10.

According to a second aspect of the present invention there is provided a pump, such as a regenerative pump, the pump comprising a plurality of pump units, at least one and preferably each of the plurality of pump units comprising a casing comprising a fluid channel or fluid passage channel; and at least one impeller provided inside the casing for pumping the fluid through the fluid channel or fluid passage channel, wherein the casing comprises at least one inlet channel and at least one outlet channel in communication with the fluid channel or fluid passage channel, the at least one inlet channel and/or the at least one outlet channel each comprising a first or axial portion at least partially and preferably substantially parallel to an axis of rotation of the at least one impeller.

The terms "axial" and/or "substantially parallel" will be understood as extending in a direction at an angle in the region of 0-45°, preferably 0-30°, more preferably 0-15° relative to an axis of rotation of the at least one impeller.

By such provision, the at least one and preferably each of the plurality of pump units may be sealably connectable, preferably axially sealably connectable, to at least one adjacent pump unit, e.g. by connection means such as thread and screws, bolts, clips or the like.

At least one and preferably each of the plurality of pump units may be in contact with, e.g. abut, at least one adjacent pump unit.

Alternatively, at least one and preferably each of the plurality of pump units may be sealably connected, preferably axially sealably connected, to at least one adjacent pump unit, e.g. by casting or moulding.

The at least one inlet channel and/or the at least one outlet channel may be peripheral to the fluid passage channel and/or the casing or housing.

The second portion may be substantially radial relative to an axis of rotation of the at least one impeller.

Alternatively, the second portion may extend from the fluid passage channel in a direction not passing through an axis of rotation of the at least one impeller.

Advantageously, the second portion may extend from the fluid passage channel in a direction at least partially and typically substantially tangential to a direction of fluid flow with the fluid passage channel or to a direction of rotation of the at least one impeller.

The second portion may extend from the fluid passage channel in a direction at least partially and typically substantially tangential to a continuous fluid flow between the second portion and the fluid passage channel. By such provision the flow of a fluid into and/or out of the fluid passage channel may be improved, e.g. reduction in fluid pressure on entry into/exit from the fluid passage channel may be minimised by provision of a smooth guidance between the fluid passage channel and the second portion of the at least one inlet and/or outlet channel. Thus, the efficiency of the pump may be enhanced.

Typically the second portion of the at least one inlet and/or outlet channel may extend from the fluid passage channel in a plane at least partially and preferably substantially perpendicular to an axis of rotation of the impeller, in a direction at an angle in the range of 0° (substantially tangential to a continuous fluid flow between the second portion and the fluid passage channel) to 90° (radial).

The pump may be defined as or comprise a multistage pump. By such provision the overall performance of the pump may be improved while optimising the compactness of the pump, e.g. keeping its size to a minimum.

Typically, the pressure rise ratio between an outlet of and an inlet of a/each of the plurality of pump unit(s) may be in the range of 1-100, and typically in the range of 1-10.

The corresponding features described in connection with the first aspect of the invention may also apply to the pump according to the second aspect of the invention, and are therefore not repeated for conciseness.

According to a third aspect of the present invention there is provided an impeller for use in a pump such as a pump according to the first or second aspect of the invention.

The at least one impeller may comprise a frame, and a plurality of vanes extending outwardly from a periphery of the frame.

The vanes may be equally spaced from each other.

Typically, the at least one impeller may comprise a number of vanes in the range of 10-60, preferably in the range of 20-50, preferably approximately 30.

The frame may comprise a hub portion connected to the shaft at or near a substantially central portion of the frame.

The diameter of the hub portion may be in the range of 5-800 mm, and typically in the range of 10-400 mm.

The frame may further comprise a flanged portion near a periphery of the frame.

Typically, the vanes may extend outwardly from a periphery of the hub portion.

The vanes may extend outwardly from a periphery of the hub portion beyond the periphery of the flanged portion.

Alternatively, the vanes may extend outwardly from a periphery of the hub portion and may be substantially flush with the periphery of the flanged portion.

Alternatively, the vanes may extend outwardly from a periphery of the hub portion inside or within the periphery of the flanged portion.

Typically, the vanes may extend substantially radially from a periphery of the hub portion.

Alternatively, the blades may extend at an angle from a periphery of the hub portion, e.g. at an inclination of 0°-60° from the radial position in a forward or rearward attitude.

The vanes may comprise a first side and a second side.

The first and/or second sides may be substantially flat or planar.

Alternatively, the vanes may be profiled and may comprise, e.g. aerofoil, twist and/or other profile configurations.

The tip of substantially diametrically opposite vanes may define an outer vane tip diameter.

The outer vane tip diameter may be in the range of 10-1000 mm, and typically in the range of 50-500 mm.

The vanes may have a substantially uniform thickness across their length.

Alternatively, the vanes may have a variable thickness across their length.

The thickness of the vanes may be in the range of 0.2-20 mm, and typically in the range of 0.5-5 mm.

Advantageously, the pump may comprise a plurality of pump units.

Conveniently, the impellers of the plurality of pump units may be connected to a drive shaft.

Preferably, the drive shaft and the impellers of the plurality of pump units may share a common axis of rotation.

The diameter of the shaft may be in the range of 10-90% of the hub portion diameter.

It is to be understood that the diameter of the shaft relative to the diameter of the hub portion may vary depending on the application envisaged for the pump. In applications requiring a multistage pump comprising a low number of pump units, such as oil pumps for, e.g. gas turbine engines or turbine gearboxes, the diameter of the shaft relative to the diameter of the hub portion may be relatively small so as to minimise the overall weight of the pump. In contrast, in applications requiring a multistage pump comprising a high number of pump units, such as electrical submersible pumps for, e.g. oil and gas recovery, the diameter of the shaft relative to the diameter of the hub portion may be relatively high so as to be capable of withstanding high mechanical constraints, e.g. torsion strength, imparted to the shaft by the driving of a high number of pump units. Therefore, the dimension of the shaft relative to the dimension of the hub portion may be adapted to suit particular applications, without the need to alter the dimension of the impeller itself, casing, or the overall dimension of the pump, thus not affecting the performance and efficiency of the pump.

Advantageously, the diameter of the shaft may be in the range of 20-90%, preferably 50-90%, more preferably 60-80% of the hub portion diameter.

According to a fourth aspect of the invention there is provided a casing for use in a pump according to the first or second aspect of the invention.

The casing may comprise one or more casing units.

Preferably, the casing may comprise a plurality of casing units.

Each of the plurality of casing units may comprise a first side facing toward a feed end of the pump, and a second side facing toward a discharge end of the pump.

The plurality of casing units may comprise a first end or feed casing unit and a second end or discharge casing unit.

The first side of the first end of the feed casing unit may be substantially solid, and may comprise an aperture connected to the at least one inlet channel of the first end or feed pump unit.

The second side of the first end or feed casing unit may be connected, e.g. sealably connected, to and/or may be in abutment with the first side of an adjacent casing unit.

The first side of the second end or discharge casing unit may be connected, e.g. sealably connected, to and/or may be in abutment with the second side an adjacent casing unit.

The second side of the second end or discharge casing unit may be substantially solid, and may comprise an aperture connected to the at least one outlet channel of the second end or discharge pump unit.

The plurality of casing units may further comprise at least one intermediate casing unit.

Typically, the first side of the at least one intermediate casing unit may be connected, e.g. sealably connected, to and/or may be in abutment with the second side of the first end or feed casing unit or to the second side of an adjacent intermediate casing unit.

Typically also, the second side of the at least one intermediate casing unit may be connected, e.g. sealably connected, to and/or may be in abutment with the first side of the second end or discharge casing unit or to the first side of an adjacent intermediate casing unit.

Typically, the first side of a casing unit may be connectable, preferably axially and/or sealably connectable, to the second side of an adjacent casing unit, e.g. by connection means such as thread and screws, bolts, clips or the like.

Alternatively, the first side of a casing unit may be connected, preferably axially and/or sealably connected, to the second side of an adjacent casing unit, e.g. by casting or moulding.

Conveniently, a pump unit may be formed by providing at least one impeller between the first side of a casing unit and the second side of an adjacent casing unit.

Advantageously, the first side of a casing unit and the second side of an adjacent casing unit may complement one another so as to form the fluid passage channel of the corresponding pump unit.

Advantageously also, the first side of a casing unit and the second side of an adjacent casing unit may complement one another so as to form the second portion of the at least one inlet and/or outlet channel of the corresponding pump unit.

The first side of a casing unit and the second side of an adjacent casing unit may complement one another so as to further form the curved portion of the at least one inlet and/or outlet channel of the corresponding pump unit.

Alternatively, the curved portion of the at least one inlet and/or outlet channel of the corresponding pump unit may be provided within at least one of the adjacent casing units.

Preferably, the first or axial portion of the at least one inlet and/or outlet channel of the corresponding pump unit may be provided within at least one of the adjacent casing units.

Typically, each pump unit may comprise one inlet channel and one outlet channel.

Typically also, one impeller may be provided between the first side of a casing unit and the second side of an adjacent casing unit.

Typically, for a pump comprising N pump units, the corresponding number of casing units may equal N+1.

The at least one casing unit may have a diameter in the range of 20-1,500 mm, and typically in the range of 50-500 mm.

The at least one casing unit may have a thickness or height in the range of 10-1100 mm, and typically in the range of 50-550 mm.

According to a fifth aspect of the invention there is provided a wellbore comprising at least one pump according to the first or second aspect of the invention.

The wellbore may comprise an Artificial Lift System (ALS) comprising at least one pump according to the first or second aspect of the invention.

Typically, the wellbore/Artificial Lift System may comprise an Electrical Submersible Pump (ESP).

The pump may be driven by a motor through a driving shaft.

The motor may be electrically operated, and connected to a power supply such as surface power supply by electrical connecting means, e.g. electrical wiring or cables.

The artificial lift system may be provided within a casing of a/the wellbore. The casing may be provided with a supply portion for allowing a downhole fluid inside the casing.

The artificial lift system may be further equipped with filtering and/or straining means for removing at least some particulate matters from the fluid to be pumped.

The fluid may comprise a natural fluid such as a fossil fuel fluid, e.g. oil or natural gas.

Advantageously, the pump may comprise a plurality of pump units.

Typically, the pressure rise ratio between an outlet of and an inlet of a/each of the plurality of pump unit(s) may be in the range of 1-100, and typically in the range of 1-10.

Typically, the incremental gain in fluid pressure provided by each of the plurality of pump units may be in the range of 20-200 psi, and typically in the range of 50-100 psi, when used for pumping oil.

Typically, the operative rotational speed of the pump may be in the range of 500-25,000 rpm, and typically in the range of 3,000-20,000 rpm.

According to a sixth aspect of the invention there is provided a gas turbine engine oil pump comprising at least one pump according to the first or second aspect of the invention.

Advantageously, the pump may comprise a plurality of pump units.

Preferably, the pump may comprise at least one feeding section for pumping oil from an oil reservoir to the gas turbine engine.

The at least one feeding section may comprise 2-5 pump units, and typically 2 pump units.

Preferably, the pump may further comprise at least one scavenging section for pumping oil from the gas turbine engine to an oil reservoir.

The at least one scavenging section may comprise 2-5 pump units, and typically 3 pump units.

Advantageously, an outlet of the at least one scavenging section may be connected to a filter means, e.g. an air/oil separator, prior to the oil being discharged into the oil reservoir.

Conveniently, the at least one feeding section and scavenging section may be connected to and/or driven by a common shaft.

According to a seventh aspect of the invention there is provided a gearbox lubrication system, e.g. a turbine gearbox lubrication system, comprising at least one pump according to the first or second aspect of the invention.

Preferably, the gearbox lubrication system may comprise a wind turbine gearbox lubrication system.

Advantageously, the pump may comprise a plurality of pump units.

Typically, the pump may be located within a nacelle of the wind turbine.

Preferably, the pump may comprise at least one feeding section for pumping oil from an oil reservoir to the gearbox lubrication system.

The at least one feeding section may comprise 2-5 pump units, and typically 2 pump units.

Preferably, the pump may further comprise at least one scavenging section for pumping oil from the gearbox lubrication system to an oil reservoir.

The at least one scavenging section may comprise 2-5 pump units, and typically 3 pump units.

Advantageously, an outlet of the at least one scavenging section may be connected to a filter means prior to the oil being discharged into the oil reservoir.

Conveniently, the at least one feeding section and scavenging section may be connected to and/or driven by a common shaft.

According to an eighth aspect of the invention there is provided a process manufacturing apparatus, e.g. a pharmaceutical or a petrochemical process assembly, comprising at least one pump according to the first or second aspect of the invention.

According to a ninth aspect of the invention there is provided a water pump apparatus, e.g. a mobile water pump apparatus, comprising at least one pump according to the first or second aspect of the invention.

The water pump apparatus may be fitted to or may comprise a mobile apparatus, e.g. a trailer, or a vehicle such as a fire engine or water tender.

According to a tenth aspect of the invention there is provided a fuel pump apparatus comprising at least one pump according to the first or second aspect of the invention.

The fuel pump apparatus may be fitted to or may comprise an automotive vehicle, e.g. an automotive engine.

According to an eleventh aspect of the invention there is provided the use of a pump according to the first or second aspect of the invention in a wellbore.

The wellbore may comprise an Artificial Lift System (ALS).

Typically, the wellbore/Artificial Lift System may comprise an Electrical Submersible Pump (ESP).

The pump may be driven by a motor through a driving shaft.

The motor may be electrically operated, and connected to a power supply such as surface power supply by electrical connecting means, e.g. electrical wiring or cables.

The artificial lift system may be provided within a casing of a/the wellbore. The casing may be provided with a supply portion for allowing a downhole fluid inside the casing.

The artificial lift system may be further equipped with filtering and/or straining means for removing at least some particulate matters from the fluid to be pumped.

The fluid may comprise a natural fluid such as a fossil fuel fluid, e.g. oil or natural gas.

Advantageously, the pump may comprise a plurality of pump units.

Typically, the incremental gain in fluid pressure provided by each of the plurality of pump units may be in the range of 20-200 psi, and typically in the range of 50-100 psi, when used for pumping oil.

Typically, the operative rotational speed of the pump may be in the range of 500-25,000 rpm, and typically in the range of 3,000-20,000 rpm.

According to a twelfth aspect of the invention there is provided the use of a pump according to the first or second aspect of the invention in a gas turbine engine oil pump.

Advantageously, the pump may comprise a plurality of pump units.

Preferably, the pump may comprise at least one feeding section for pumping oil from an oil reservoir to the gas turbine engine.

The at least one feeding section may comprise 2-5 pump units, and typically 2 pump units.

Preferably, the pump may further comprise at least one scavenging section for pumping oil from the gas turbine engine to an oil reservoir.

The at least one scavenging section may comprise 2-5 pump units, and typically 3 pump units.

Typically, the number of pump units in the at least one scavenging section may be at least equal to and typically greater than the number of pump units in the at least one feeding section.

Alternatively, the number of pump units in the at least one scavenging section may be less than the number of pump units in the at least one feeding section.

Advantageously, an outlet of the at least one scavenging section may be connected to a filter means, e.g. an air/oil separator, prior to the oil being discharged into the oil reservoir.

Conveniently, the at least one feeding section and scavenging section may be connected to and/or driven by a common shaft.

Advantageously, the pump may be operable clockwise and/or counterclockwise.

According to a thirteenth aspect of the invention there is provided the use of a pump according to the first or second aspect of the invention in a gearbox lubrication system, e.g. a turbine gearbox lubrication system.

Preferably, the gearbox lubrication system may comprise a wind turbine gearbox lubrication system.

Advantageously, the pump may comprise a plurality of pump units.

Typically, the pump may be located within a nacelle of the wind turbine.

Preferably, the pump may comprise at least one feeding section for pumping oil from an oil reservoir to the gearbox lubrication system.

The at least one feeding section may comprise 2-5 pump units, and typically 2 pump units.

Preferably, the pump may further comprise at least one scavenging section for pumping oil from the gearbox lubrication system to an oil reservoir.

The at least one scavenging section may comprise 2-5 pump units, and typically 3 pump units.

Typically, the number of pump units in the at least one scavenging section may be at least equal to and typically greater than the number of pump units in the at least one feeding section.

Alternatively, the number of pump units in the at least one scavenging section may be less than the number of pump units in the at least one feeding section.

Advantageously, an outlet of the at least one scavenging section may be connected to a filter means prior to the oil being discharged into the oil reservoir.

Conveniently, the at least one feeding section and scavenging section may be connected to and/or driven by a common shaft.

Advantageously, the pump may be operable clockwise and/or counterclockwise.

According to a fourteenth aspect of the invention there is provided the use of a pump according to the first or second aspect of the invention in a process manufacturing apparatus, e.g. a pharmaceutical or a petrochemical process assembly.

According to a fifteenth aspect of the invention there is provided the use of a pump according to the first or second aspect of the invention in water pump apparatus, e.g. a mobile water pump apparatus.

The water pump apparatus may be fitted to or may comprise a mobile apparatus, e.g. a trailer, or a vehicle such as a fire engine or water tender.

According to a sixteenth aspect of the invention there is provided the use of a pump according to the first or second aspect of the invention in a fuel pump apparatus.

The fuel pump apparatus may be fitted to or may comprise an automotive vehicle, e.g. an automotive engines.

According to a seventeenth aspect of the invention there is provided a pump, such as a regenerative pump, the pump comprising at least one pump unit, the at least one pump unit comprising a casing or housing comprising a fluid passage channel; and at least one impeller provided inside the casing for pumping the fluid through the fluid passage channel, wherein the casing or housing comprises at least one outlet channel in communication with the fluid passage channel, the at least one outlet channel comprising at least a portion extending from the fluid passage channel in a direction at least partially tangential to a direction of fluid flow with the fluid passage channel or of rotation of the at least one impeller.

Preferably, the casing or housing comprises at least one inlet channel.

Preferably, the at least one outlet channel may be peripheral to the fluid passage channel and/or the casing or housing.

Preferably, the at least one portion of the at least one outlet channel may extend from the fluid passage channel in a direction substantially tangential to a continuous fluid flow between the fluid passage channel and the outlet channel portion.

Preferably, the at least one inlet channel may be peripheral to the fluid passage channel and/or the casing or housing.

BRIEF DESCRIPTION OF DRAWINGS

Embodiments of the invention will now be described by way of example only, and with reference to the accompanying drawings, which are.

DETAILED DESCRIPTION OF DRAWINGS

Figure 1:
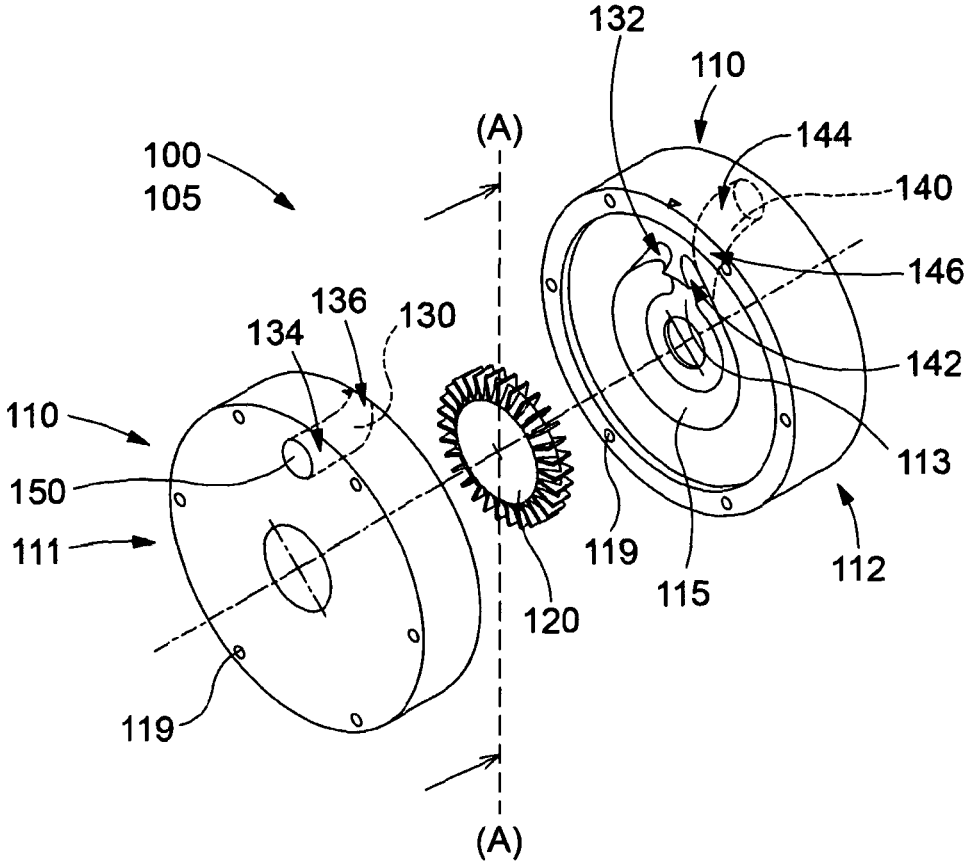
FIG. 1 a perspective exploded view of a regenerative pump according to a first embodiment of a first aspect of the present invention.
Figure 2:
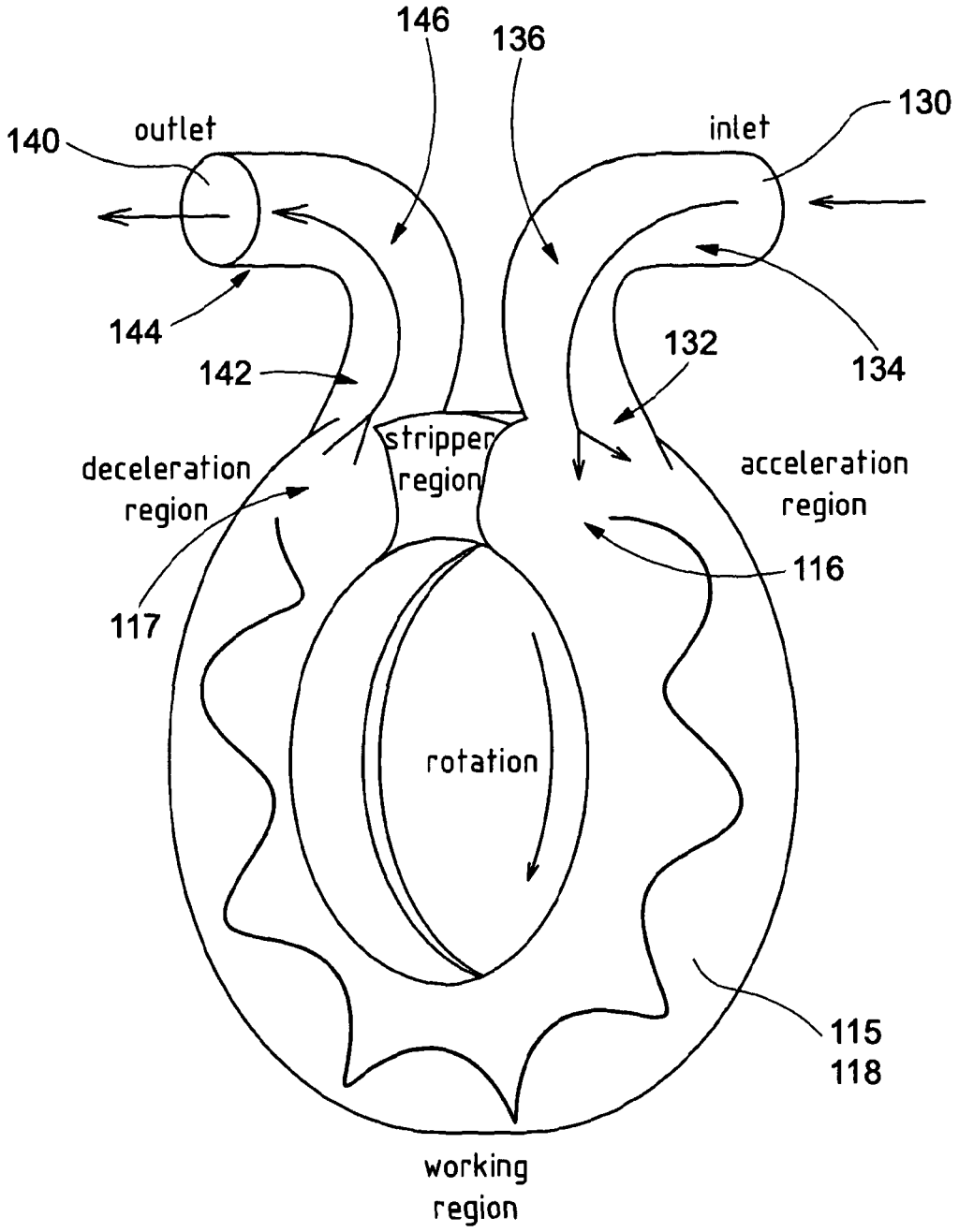
FIG. 2 an elevated partial view of the pump of FIG. 1 showing fluid flow through an inlet, fluid passage channel and outlet portions.

Referring to FIGS. 1 to 8 there is shown a regenerative pump 100 according to a first embodiment of a first aspect of the present invention.

The pump 100 comprises a pump unit 105.

The pump unit 105 comprises a casing 110 comprising a fluid passage channel 115. The pump unit 105 further comprises an impeller 120 provided inside the casing 110 for pumping a fluid through the fluid passage channel 115.

In this embodiment, the casing 110 comprises an inlet channel 130 and an outlet channel 140 in communication with the fluid passage channel 115.

In this embodiment, the inlet channel 130 comprises a first or axial portion 134 substantially parallel to an axis of rotation of the impeller 120, and the outlet channel 140 comprises a first or axial portion 144 substantially parallel to an axis of rotation of the impeller 120.

The inlet channel 130 comprises a second portion 132 extending from the fluid passage channel 115 in a plane substantially perpendicular to an axis of rotation of the impeller 120. The outlet channel 140 comprises a second portion 142 extending from the fluid passage channel 115 in a plane substantially perpendicular to an axis of rotation of the impeller 120.

In this embodiment, the second portion 132,142 respectively of the inlet channel 130 and the outlet channel 140 extend from the fluid passage channel 115 in a direction substantially tangential to a continuous fluid flow between the second portion 132,142 and the fluid passage channel 115.

The first or axial portion 134 and the second portion 132 of the inlet channel 130 are in communication with one another and are connected by a curved portion 136. The first or axial portion 144 and the second portion 142 of the outlet channel 140 are in communication with one another and are connected by a curved portion 146.

In this embodiment, the first or axial 134,144, second 132,142 and curved portion 136,146 of the inlet 130 and outlet 140 channels are substantially tubular, i.e., substantially circular in cross-section.

In an alternative embodiment, the first or axial 134,144, second 132,142 and/or curved portion 136,146 of the inlet 130 and outlet 140 channels may be substantially non-circular in cross-section.

In this embodiment, the first or axial 134,144, second 132,142 and/or curved portion 136,146 of the inlet 130 and outlet 140 channels have a diameter in the range of 1-100 mm, and typically in the range of 5-50 mm.

Conveniently, the casing 110 is provided with a barrier or stripper 113 separating a fluid passage channel portion 116 near the inlet channel 130 from a fluid passage channel portion 117 near the outlet channel 140. By such provision a hydraulic seal is provided between high pressure and low pressure regions of the pump unit 105.

Figure 5:
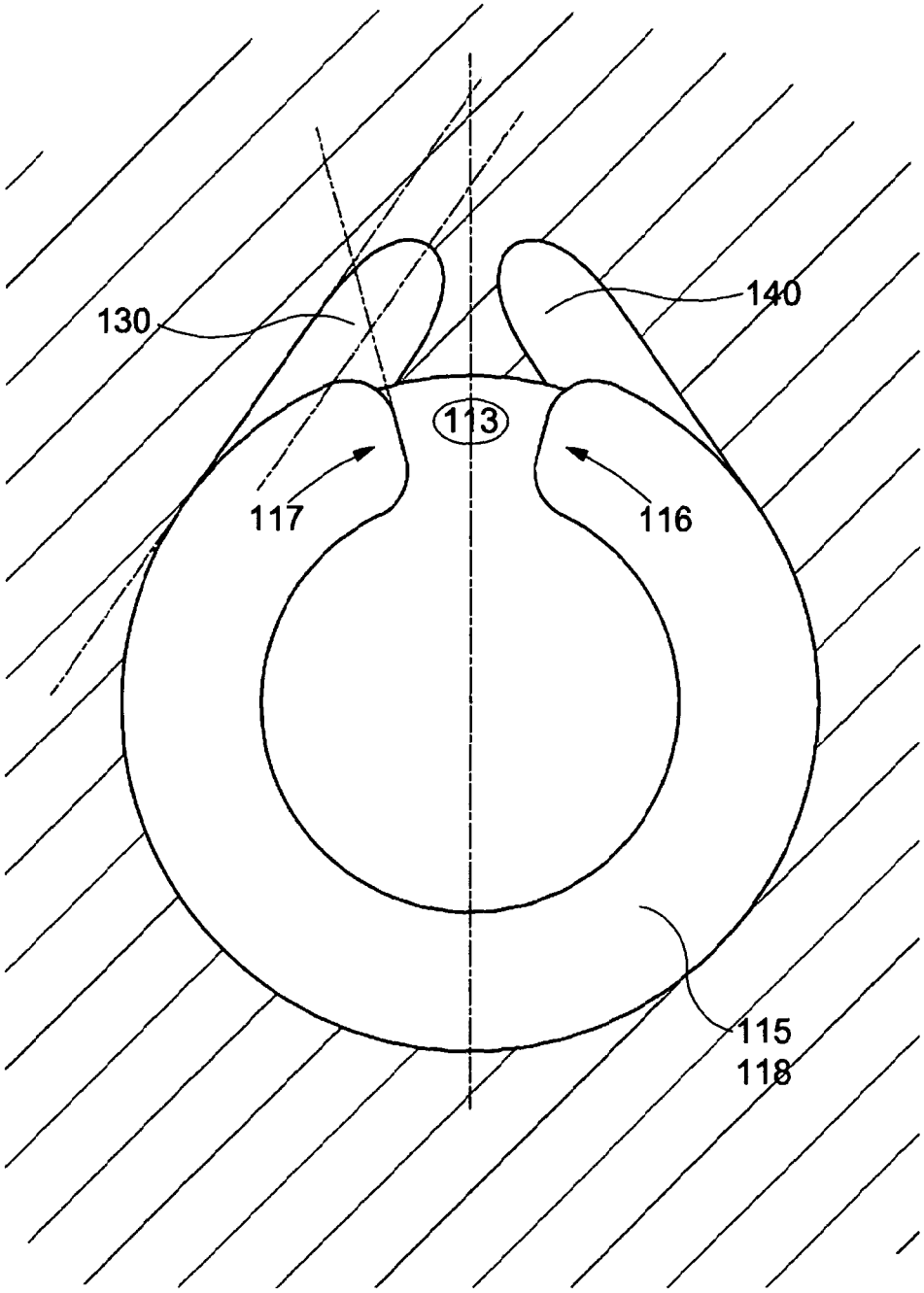
FIG. 5 a cross-sectional view of the casing of the pump of FIG. 1 perpendicular to an axis of rotation of the impeller.
Figure 6:
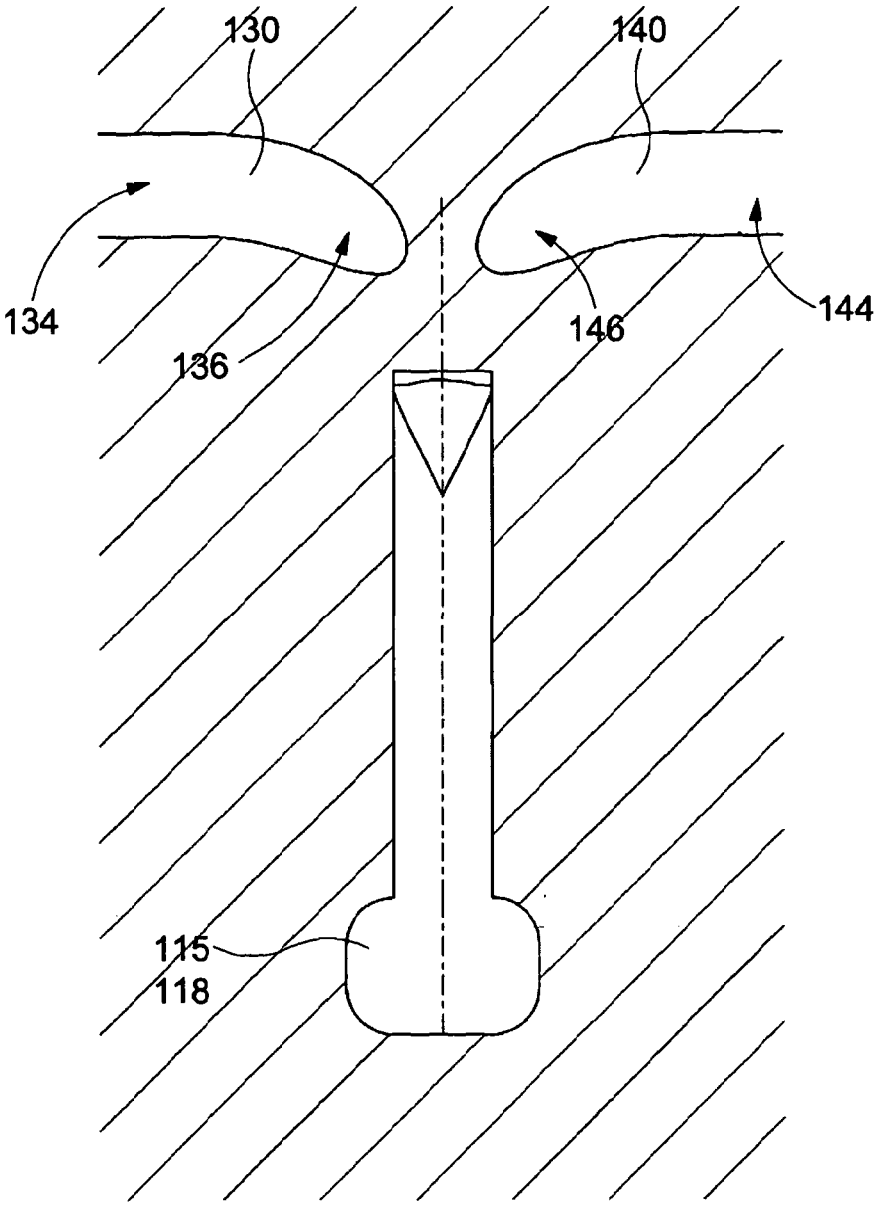
FIG. 6 a cross-sectional view of the casing of the pump of FIG. 3 taken along a line (C-C)
Figure 7:
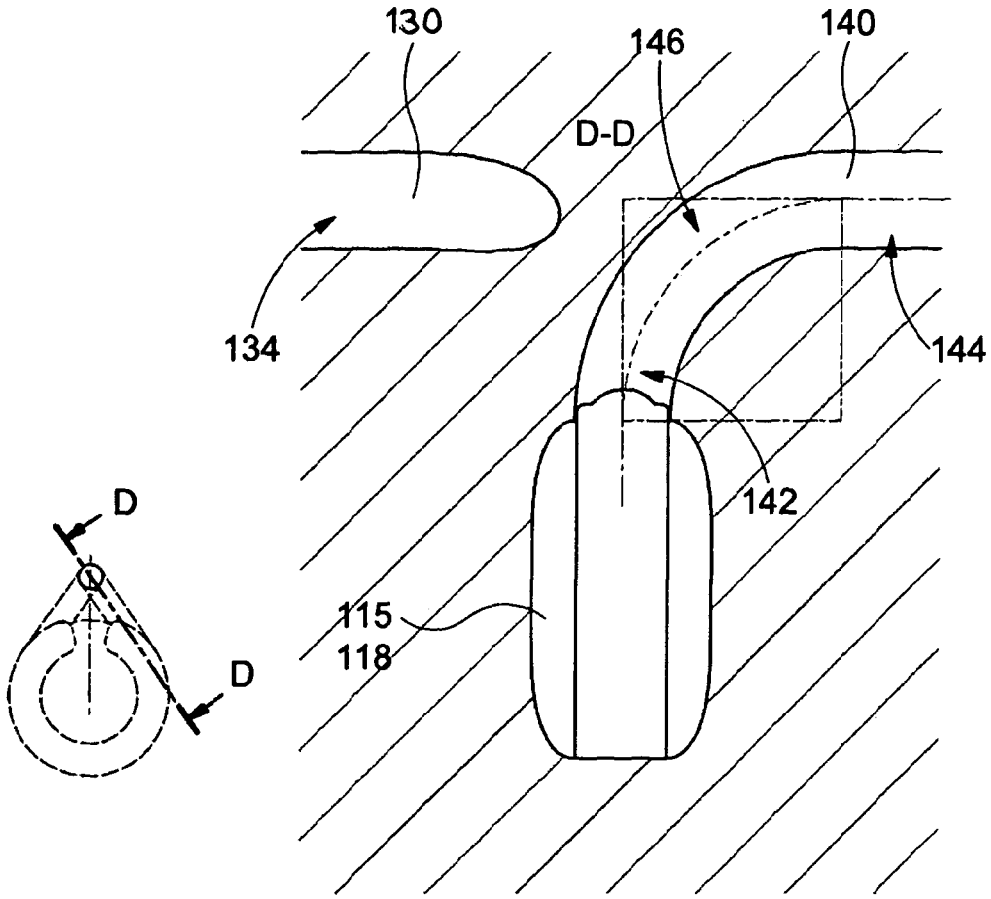
FIG. 7 a cross-sectional view of the casing of the pump of FIG. 3 taken along a line (D-D)
Figure 8:
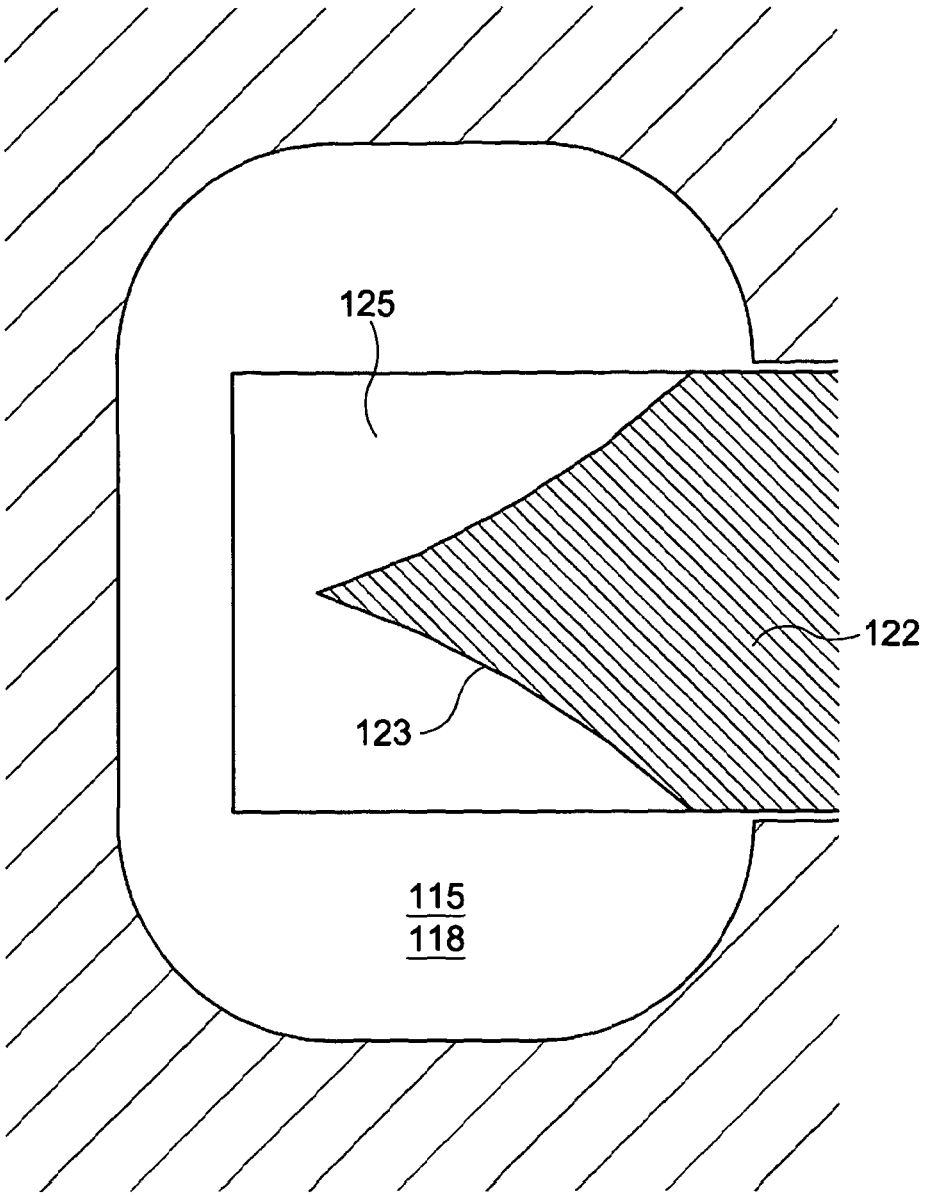
FIG. 8 an enlarged view of an end portion of a vane of the impeller of FIG. 4*a* within a fluid passage channel.

In this embodiment, as shown on FIG. 5, the dimension of the barrier or stripper 113 is approximately 30° between or relative to the fluid passage channel portion 116 near the inlet channel 130 and the fluid passage channel portion 117 near the outlet channel 140.

In an alternative embodiment, the dimension of the barrier or stripper 113 may be in the range of 10-100°, preferably 20-50° between inlet 116 and outlet portions 117 of the fluid passage channel 115.

Figure 3:
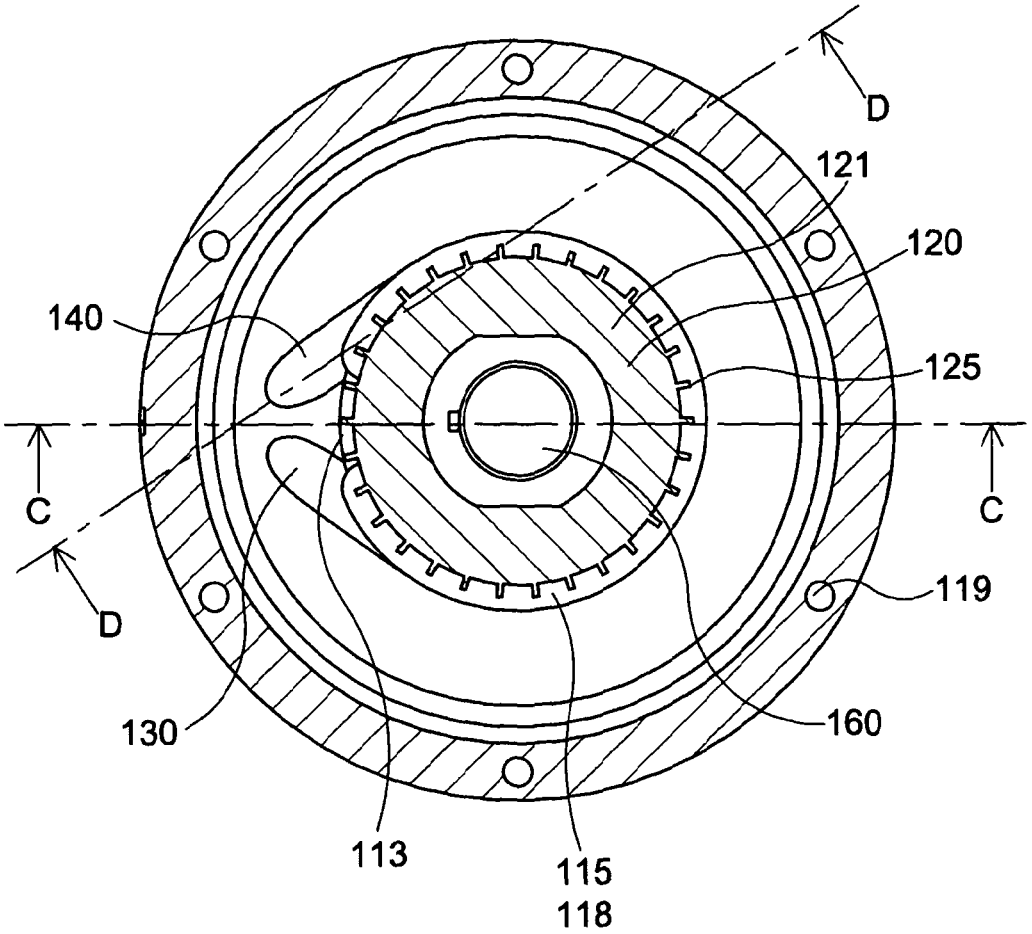
FIG. 3 a cross-sectional view of the pump of FIG. 1 taken along a line (A-A)
Figure 4A:
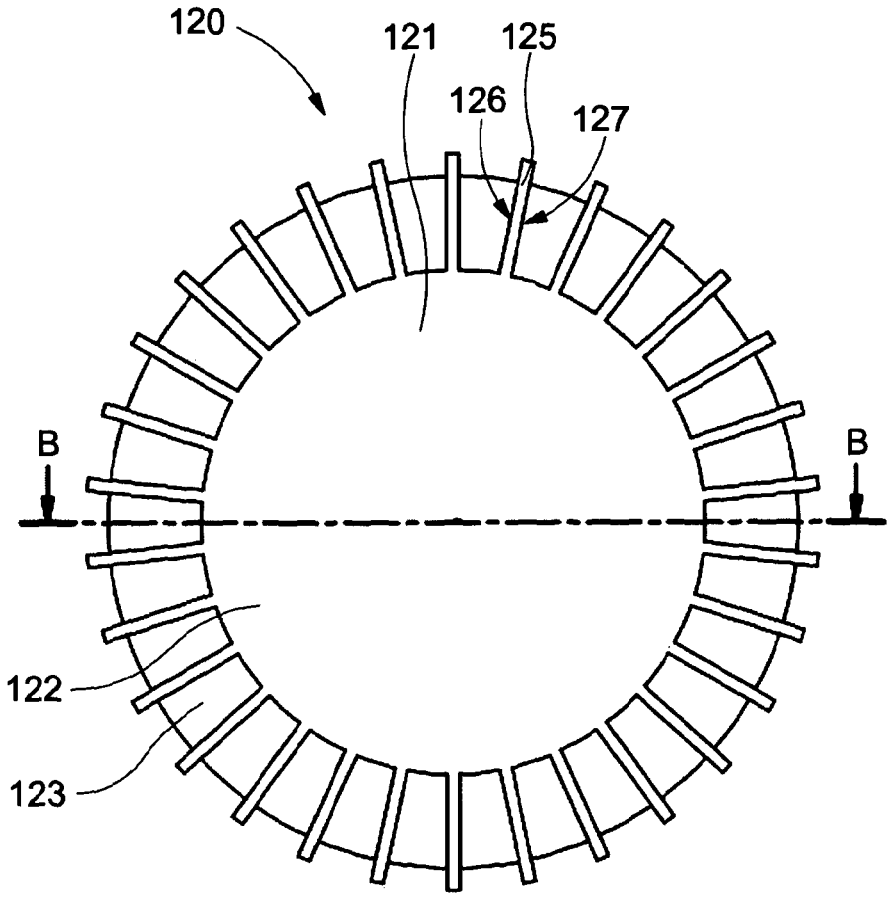
FIG. 4*a* a longitudinal cross-sectional view of the impeller of the pump of FIG. 1.
Figure 4B:
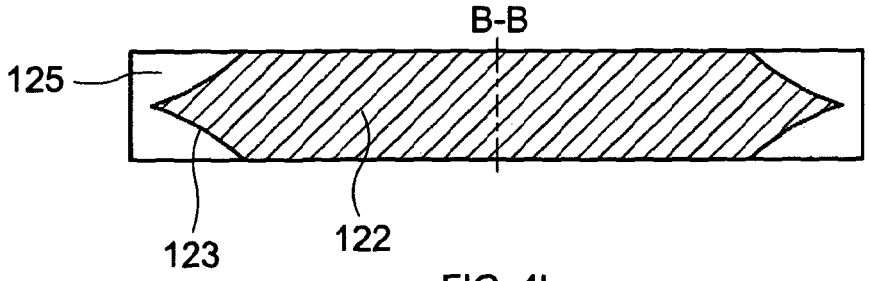
FIG. 4*b* a transversal cross-sectional view of the impeller of FIG. 4*a* taken along a line (B-B)

Referring to FIGS. 3, 4*a* and 4*b*, the impeller 120 comprises a frame 121, and a plurality of vanes 125 extending outwardly from a periphery of the frame 121.

In this embodiment the impeller 120 comprises thirty vanes 125 which are equally spaced from each other.

The frame 121 comprises a hub portion 122 connected to a shaft 160 at or near a substantially central portion of the frame 121.

The shaft 160 and the impeller 120 share a common axis of rotation.

The diameter of the shaft 160 may be in the range of 10-90% of the hub portion 122 diameter.

The diameter of the hub portion 122 is in the range of 5-800 mm, and typically in the range of 10-400 mm.

The frame 121 further comprises a flanged portion 123 near a periphery of the frame 121. The flanged portion 123 is substantially concave.

The vanes 125 extend outwardly from a periphery of the hub portion 122 beyond the periphery of the flanged portion 123.

In an alternative embodiment, the vanes 125 may extend outwardly from a periphery of the hub portion 122 and be substantially flush with the periphery of the flanged portion 123.

In another alternative embodiment, the vanes 125 may extend outwardly from a periphery of the hub portion 122 inside or within the periphery of the flanged portion 123.

The vanes 125 extend substantially radially from a periphery of the hub portion 122.

In an alternative embodiment, the vanes may extend at an angle from a periphery of the hub portion, e.g. at an inclination of 0°-60° from the radial position in a forward or rearward attitude.

The vanes 125 comprise a first side 126 and a second side 127.

The first side 126 and second side 127 are substantially flat or planar.

In an alternative embodiment, the vanes 125 may be profiled and may comprise, e.g. aerofoil, twist and/or other profile configurations.

The tip of substantially diametrically opposite vanes 125 defines an outer vane tip diameter.

The outer vane tip diameter is in the range of 10-1000 mm, and typically in the range of 50-500 mm.

The vanes 125 have a substantially uniform thickness across their length.

In an alternative embodiment, the vanes 125 may have a variable thickness across their length.

The thickness of the vanes 125 is in the range of 0.2-20 mm, and typically in the range of 0.5-5 mm.

The fluid passage channel 115 is in the form of a conduit 118 having a depth and a height.

In this embodiment, the conduit 118 is substantially non-circular in cross-section, and has a depth/height aspect ratio in the range of 0.4-1.2, and typically in the range of 0.6-1.

In an alternative embodiment, the conduit 118 may be substantially circular in cross-section.

Typically, the inlet channel 130 of the pump unit 105 is connected to a fluid supply, and the outlet channel 140 of the pump unit 105 is connected to a fluid discharge system.

In this embodiment, the casing 110 comprises a first end or feed casing unit 111 and a second end or discharge casing unit 112.

In an alternative embodiment, the casing 110 may comprise a single casing unit.

The first end or feed casing unit 111 and a second end or discharge casing unit 112 each comprise a first side facing toward a feed end of the pump, and a second side facing toward a discharge end of the pump.

The first side of the first end or feed casing unit 111 is substantially solid and planar, and comprises an aperture 150 connected to the inlet channel 130 of the pump unit 105.

In this embodiment, the second side of the first end or feed casing unit 111 is axially sealably connected to and in abutment with the first side of the second end or discharge casing unit 112 by connection means such as screws or bolts (not shown) provided within holes or recesses 119.

The second side of the second end or discharge casing unit 112 is substantially solid and planar, and comprises an aperture (not shown) connected to the outlet channel 140 of the pump unit 105.

The second side of the first end or feed casing unit 111 comprises part of the fluid passage channel 115 of the pump unit 105, part of the second portion 132 of the inlet channel 130, and part of the second portion 142 of the outlet channel 140. The first side of the second end or discharge casing unit 112 also comprises part of the fluid passage channel 115 of the pump unit 105, part of the second portion 132 of the inlet channel 130, and part of the second portion 142 of the outlet channel 140.

The pump unit 105 is formed by providing the impeller 120 between the second side of the first end or feed casing unit 111 and the first side of the second end or discharge casing unit 112.

Advantageously, the second side of the first end or feed casing unit 111 and the first side of the second end or discharge casing unit 112 complement one another so as to form the fluid passage channel 115 of the pump unit 105.

Advantageously also, the second side of the first end or feed casing unit 111 and the first side of the second end or discharge casing unit 112 complement one another so as to form the second portion 132 of the inlet channel 130 and the second portion 142 of the outlet channel 140.

In this embodiment, the curved portions 136,146 of the inlet and/or outlet channels 130,140 may be provided within the first end or feed casing unit 111 or the second end or discharge casing unit 112.

In an alternative embodiment, the second side of the first end or feed casing unit 111 and the first side of the second end or discharge casing unit 112 complement one another so as to form the curved portion 136 of the inlet channel 130 and the curved portion 146 of the outlet channel 140.

The first or axial portion 134 of the inlet channel 130 is provided within the first end or feed casing unit 111.

The first or axial portion 144 of the outlet channel 140 is provided within the second end or discharge casing unit 112.

The first 111 and/or second 112 end casing unit has a diameter in the range of 20-1,500 mm, and typically in the range of 50-500 mm.

The first 111 and/or second 112 end casing unit has a thickness or height in the range of 10-1100 mm, and typically in the range of 50-550 mm.

Advantageously, the impeller 120 is capable of rotating clockwise and/or counter-clockwise.

Preferably, the impeller 120 is capable of being rotated clockwise and counter-clockwise. By such provision the pump 100 may be used in a first or normal fluid direction and in a second or reverse fluid direction. This allows a user to reverse the direction in which a fluid is being pumped as required.

Figure 9:
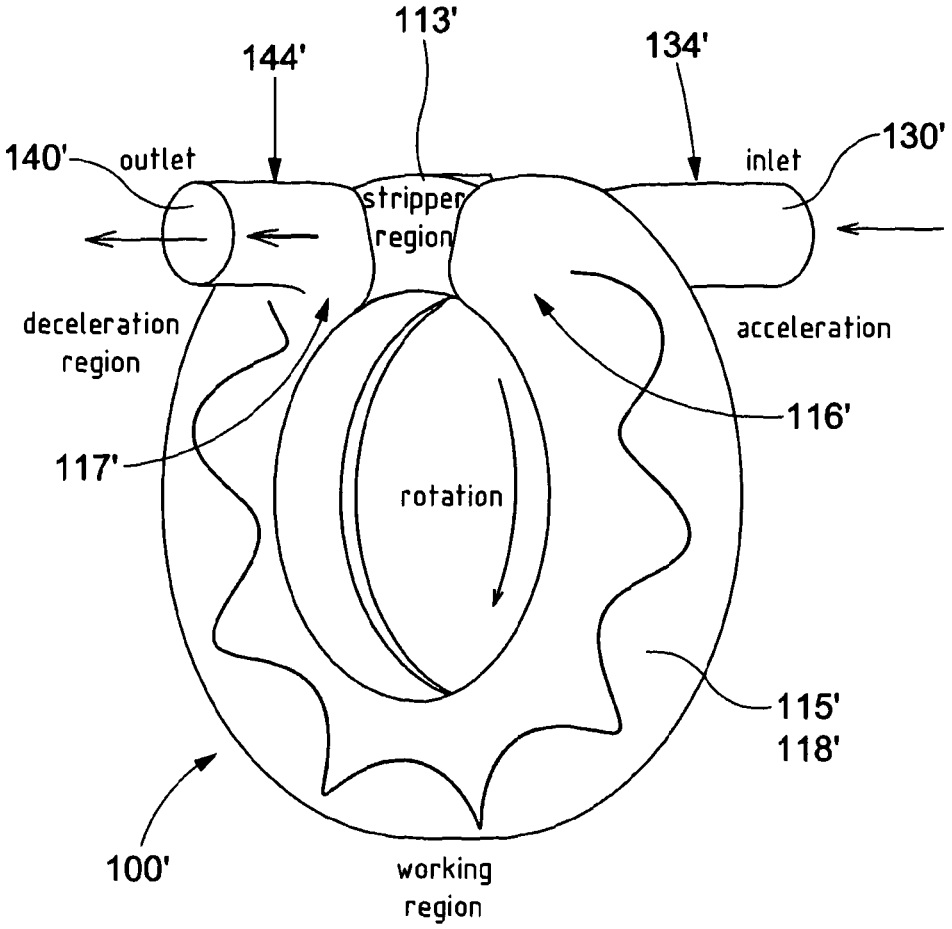
FIG. 9 an elevated partial view of a regenerative pump according to a second embodiment of a first aspect of the present invention showing fluid flow through an inlet, fluid passage channel and outlet portions.

Referring to FIG. 9 there is shown an elevated partial view of a regenerative pump according to a second embodiment of a first aspect of the present invention.

In this embodiment, the pump 100' is a pump of generally similar design to the pump 100 described in FIGS. 1 to 8. Like parts are denoted by like numerals, supplemented by "'".

In this embodiment, the inlet channel 130' comprises a first or axial portion 134' substantially parallel to an axis of rotation of the impeller (not shown), and the outlet channel 140' comprises a first or axial portion 144' substantially parallel to an axis of rotation of the impeller.

In this embodiment, the first or axial portion 134' of the inlet channel 130' extends from the fluid passage channel 115' substantially parallel to an axis of rotation of the impeller and/or substantially perpendicular to a plane comprising the fluid passage channel 115'. The first or axial portion 144' of the outlet channel 140' extends from the fluid passage channel 115' substantially parallel to an axis of rotation of the impeller and/or substantially perpendicular to a plane containing the fluid passage channel 115'.

The phrase "substantially parallel" will be understood as extending in a direction at an angle in the region of 0-45°, preferably 0-30°, more preferably 0-15° relative to an axis of rotation of the at least one impeller. By such provision, connection of the first or axial portion 134' of the inlet channel 130' with the first or axial portion of the outlet channel of an adjacent pump unit (not shown), and connection of the first or axial portion 144' of the outlet channel 140' with the first or axial portion of the inlet channel of an adjacent pump unit (not shown), is made possible.

In this embodiment, the dimension of the barrier or stripper 113' is approximately 30° between or relative to the fluid passage channel portion 116' near the inlet channel 130' and the fluid passage channel portion 117' near the outlet channel 140'.

In an alternative embodiment, the dimension of the barrier or stripper 113' may be in the range of 10-100°, preferably 20-50° between inlet 116' and outlet portions 117' of the fluid passage channel 115'.

Figure 10:
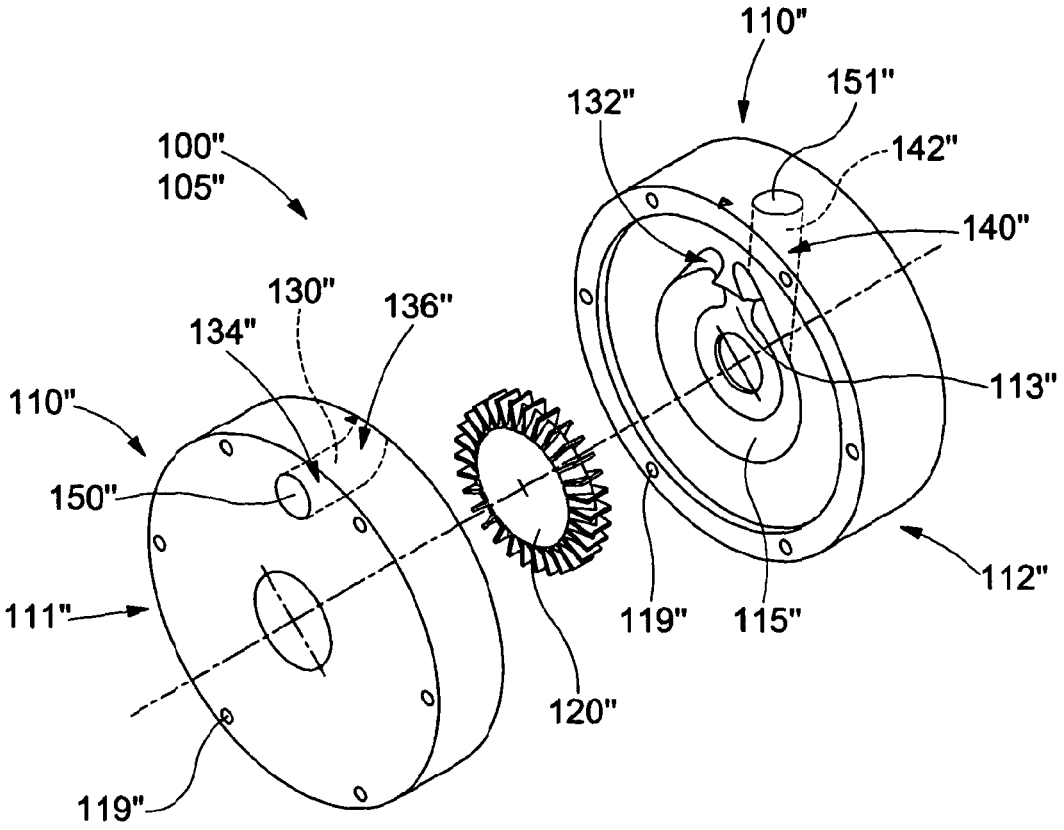
FIG. 10 a perspective exploded view of a regenerative pump according to a third embodiment of a first aspect of the present invention.

Referring to FIG. 10 there is shown a perspective exploded view of a regenerative pump according to a third embodiment of a first aspect of the present invention.

In this embodiment, the pump 100" is a pump of generally similar design to the pump 100 described in FIGS. 1 to 8, like parts being denoted by like numerals, supplemented by "'".

In this embodiment, the outlet channel 140" comprises a second portion 142" extending from the fluid passage channel 115" in a plane substantially perpendicular to an axis of rotation of the impeller 120", and in this embodiment in a direction substantially radial relative to an axis of rotation of the impeller 120".

In this embodiment, the outlet channel 140" does not comprise a first or axial portion or a curved portion.

The configuration of the pump 100" may be particularly useful for use in pump assemblies where radial discharge is desired, e.g. for use in the casing or "shell" of an existing centrifugal pump assembly, while maintaining the improved performance of a regenerative pump.

In this embodiment, the pump 100" is a single stage pump, i.e. comprises one pump 100", wherein the inlet channel 130" comprises a first or substantially axial portion 134" and wherein the outlet channel 140" does not comprise a first or axial portion or a curved portion.

In an alternative embodiment, the pump 100" may be reversed so that the outlet channel 140" comprises a first or substantially axial portion and the inlet channel 130" does not comprise a first or axial portion or a curved portion.

In an alternative embodiment, the pump 100" may comprise the second end or discharge pump unit of a multistage pump, i.e. of a pump comprising more than one pump unit.

In an advantageous embodiment, the first end or feed pump unit and each of the intermediate pump units comprise a pump 100 as described in FIGS. 1 to 8, and the second end or discharge pump unit comprises a pump 100" as described in FIG. 10.

By such provision the pump may be particularly useful for use in pump assemblies where radial discharge is desired, e.g. for use in the casing or "shell" of an existing centrifugal pump assembly, while maintaining the improved performance of a multistage regenerative pump configuration.

Figure 11:
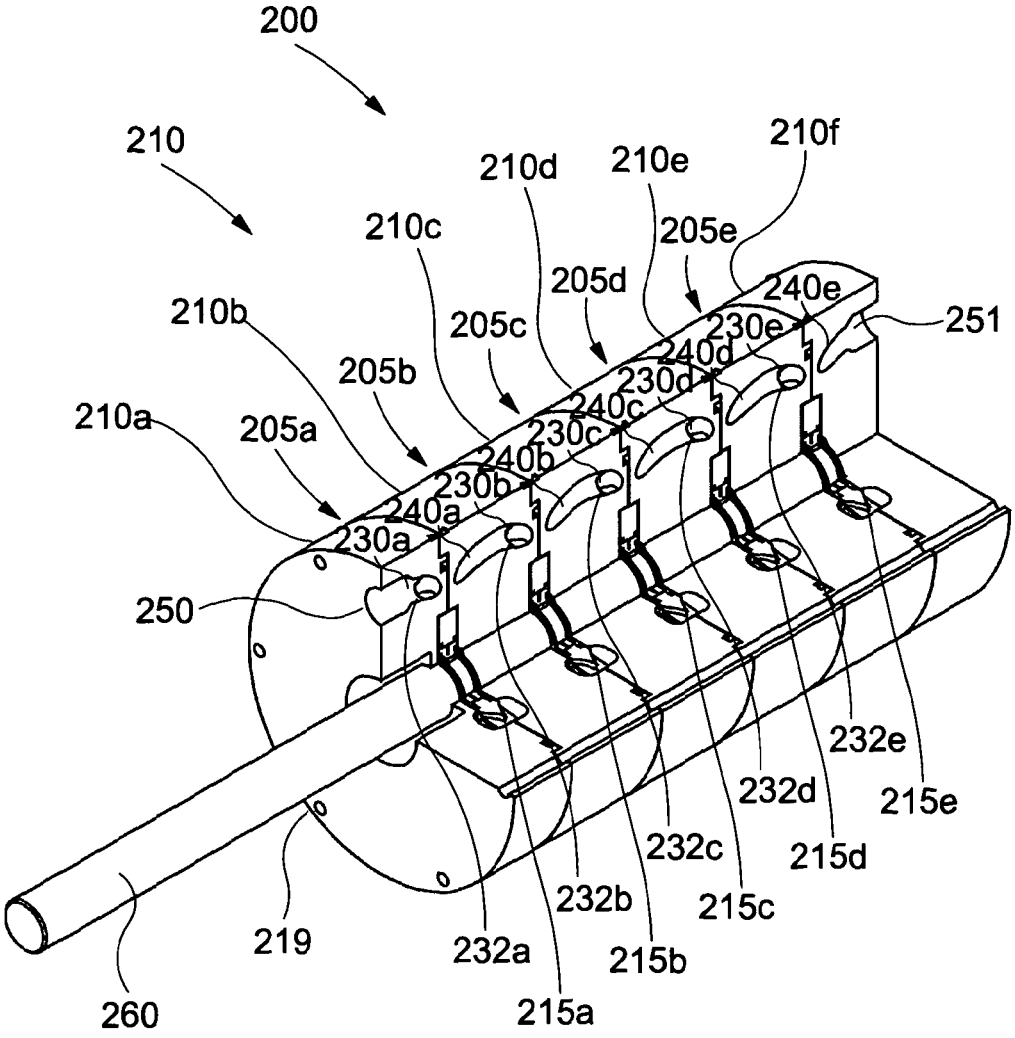
FIG. 11 a perspective cutaway view of a multistage regenerative pump according to a first embodiment of a second aspect of the present invention.
Figure 12:
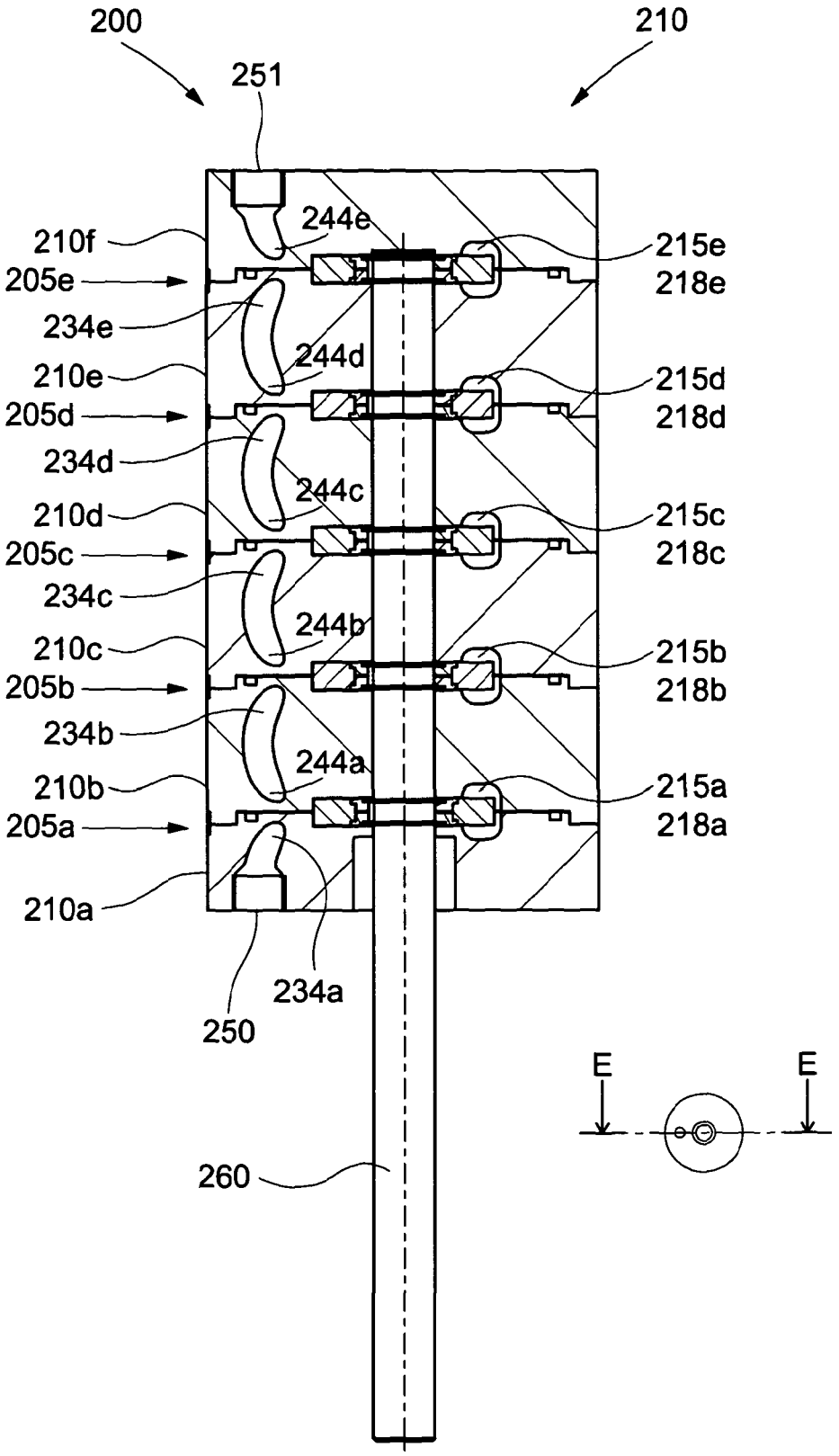
FIG. 12 a cross-sectional view of the pump of FIG. 11 taken along a line (E-E)
Figure 13:
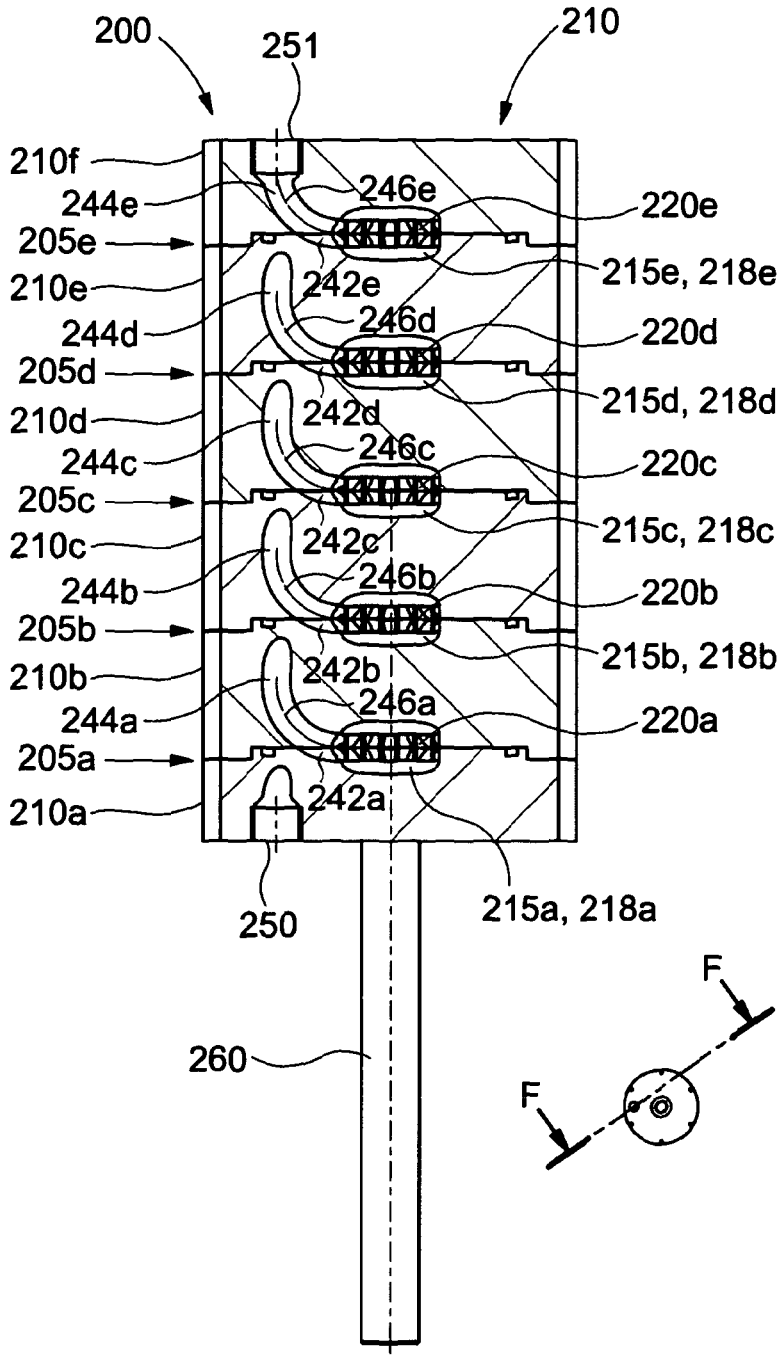
FIG. 13 a cross-sectional view of the pump of FIG. 11 taken along a line (F-F)

Referring to FIGS. 11 to 13 there is shown a regenerative pump 200 according to a first embodiment of a second aspect of the present invention.

In this embodiment, the pump 200 is a 'multistage' regenerative pump comprising a plurality of pump units 205*a*,205*b*,205*c*,205*d*,205*e* of a generally similar design to the pump unit 105 described in FIGS. 1 to 8. Like parts are denoted by like numerals, incremented by '100'.

In this embodiment, the pump 200 comprises five pump units 205*a*,205*b*,205*c*,205*d*,205*e*.

In an alternative embodiment, the pump 200 may comprise 2-300 pumps units, depending on the type of application envisaged for the pump.

Each of the pump units 205*a*,205*b*,205*c*,205*d*,205*e* comprises a casing, each comprising a fluid passage channel 215*a*,215*b*,215*c*,215*d*,215*e*.

Each of the pump units 205*a*,205*b*,205*c*,205*d*,205*e* further comprises a impeller 220*a*,220*b*,220*c*,220*d*,220*e* provided respectively inside the casing for pumping the fluid through the fluid passage channel 215*a*,215*b*,215*c*,215*d*,215*e*.

In this embodiment, each casing respectively comprises an inlet channel 230*a*,230*b*,230*c*,230*d*,230*e* and an outlet channel 240*a*,240*b*,240*c*,240*d*,240*e*.

Each of the inlet channels 230*a*,230*b*,230*c*,230*d*,230*e* respectively comprises a first or axial portion 234*a*,234*b*,234*c*,234*d*,234*e* substantially parallel to an axis of rotation of the impeller 220*a*,220*b*,220*c*,220*d*,220*e*. Each of the outlet channels 240*a*,240*b*,240*c*,240*d*,240*e* respectively comprises a first or axial portion 244*a*,244*b*,244*c*,244*d*,244*e* substantially parallel to an axis of rotation of the impeller 220*a*,220*b*,220*c*,220*d*,220*e*.

In this embodiment, each of the inlet channels 230*a*,230*b*,230*c*,230*d*,230*e* respectively comprises a second portion 232*a*,232*b*,232*c*,232*d*,232*e* extending from the fluid passage channel 215*a*,215*b*,215*c*,215*d*,215*e* in a plane substantially perpendicular to an axis of rotation of the impeller 220*a*,220*b*,220*c*,220*d*,220*e*. Each of the outlet channels 240*a*,240*b*,240*c*,240*d*,240*e* respectively comprises a second portion 242*a*,242*b*,242*c*,242*d*,242*e* extending from the fluid passage channel 215*a*,215*b*,215*c*,215*d*,215*e* in a plane substantially perpendicular to an axis of rotation of the impeller 220*a*,220*b*,220*c*,220*d*,220*e*.

In this embodiment, the second portion 232*a*,232*b*,232*c*,232*d*,232*e* of the respective inlet channel 230*a*,230*b*,230*c*,230*d*,230*e* extends from the fluid passage channel 215*a*,215*b*,215*c*,215*d*,215*e* in a direction substantially tangential to a continuous fluid flow between the first portion 232*a*,232*b*,232*c*,232*d*,232*e* and the fluid passage channel 215*a*,215*b*,215*c*,215*d*,215*e*.

In this embodiment, the second portion 242*a*,242*b*,242*c*,242*d*,242*e* of the respective outlet channel 240*a*,240*b*,240*c*,240*d*,240*e* extends from the fluid passage channel 215*a*,215*b*,215*c*,215*d*,215*e* in a direction substantially tangential to a continuous fluid flow between the first portion 242*a*,242*b*,242*c*,242*d*,242*e* and the fluid passage channel 215*a*,215*b*,215*c*,215*d*,215*e*.

The first or axial portion 234*a*,234*b*,234*c*,234*d*,234*e* and the second portion 232*a*,232*b*,232*c*,232*d*,232*e* of each of the inlet channels 230*a*,230*b*,230*c*,230*d*,230*e* are in communication with one another and are connected respectively by a curved portion 236*a*,236*b*,236*c*,236*d*,236*e*.

The first or axial portion 244*a*,244*b*,244*c*,244,244*e* and the second portion 242*a*,242*b*,242*c*,242*d*,242*e* of each of the outlet channels 240*a*,240*b*,240*c*,240*d*,240*e* are in communication with one another and are connected respectively by a curved portion 246*a*,246*b*,246*c*,246*d*,246*e*.

In this embodiment, the first or axial 234*a*,234*b*,234*c*,234*d*,234*e*,244*a*,244*b*,244*c*,244*d*,244*e*, second 232*a*,232*b*,232*c*,232*d*,232*e*,242*a*,242*b*,242*c*,242*d*,242*e*, and curved portion 236*a*,236*b*,236*c*,236*d*,236*e*, 246*a*,246*b*,246*c*,246*d*,246*e* of the inlet 230*a*,230*b*,230*c*,230*d*,230*e* and outlet 240*a*,240*b*,240*c*,240*d*,240*e* channels are substantially tubular, i.e., substantially circular in cross-section.

In an alternative embodiment, the first or axial 234*a*,234*b*,234*c*,234*d*,234*e*,244*a*,244*b*,244*c*,244*d*,244*e*, second 232*a*,232*b*,232*c*,232*d*,232*e*,242*a*,242*b*,242*c*,242*d*,242*e*, and curved portion 236*a*,236*b*,236*c*,236*d*,236*e*, 246*a*,246*b*,246*c*,246*d*,246*e* of the inlet 230*a*,230*b*,230*c*,230*d*,230*e* and outlet 240*a*,240*b*,240*c*,240*d*,240*e* channels are substantially non-circular in cross-section.

In this embodiment, the first or axial 234*a*,234*b*,234*c*,234*d*,234*e*, 244*a*,244*b*,244*c*,244*d*,244*e*, second 232*a*,232*b*,232*c*,232*d*,232*e*, 242*a*,242*b*,242*c*,242*d*,242*e*, and curved portions 236*a*,236*b*,236*c*,236*d*,236*e*, 246*a*,246*b*,246*c*,246*d*,246*e*, have a diameter in the range of 1-100 mm, and typically in the range of 5-50 mm.

Conveniently, each casing is provided with a barrier or stripper (not shown) separating a fluid passage channel portion near the respective inlet channel 230*a*,230*b*,230*c*,230*d*,230*e* from a fluid passage channel portion near the respective outlet channel 240*a*,240*b*,240*c*,240*d*,240*e*. By such provision a hydraulic seal is provided between high pressure and low pressure regions of each of the pump units 205*a*,205*b*,205*c*,205*d*,205*e*.

In this embodiment, the dimension of the barrier or stripper is approximately 30° between or relative to the fluid passage channel portion near an inlet channel 230*a*,230*b*,230*c*,230*d*,230*e* and the fluid passage channel portion near a respective outlet channel 240*a*,240*b*,240*c*,240*d*,240*e*.

In an alternative embodiment, the dimension of the barrier or stripper may be in the range of 10-100°, preferably 20-50° between inlet and corresponding outlet portions of a/each fluid passage channel 215*a*,215*b*,215*c*,215*d*,215*e*.

In this embodiment, each of the impellers 220*a*,220*b*, 220*c*,220*d*,220*e* is an impeller 120 as described in FIGS. 3, 4*a* and 4*b* in relation to the first embodiment of the first aspect of the invention.

Each of the fluid passage channels 215*a*,215*b*,215*c*,215*d*, 215*e* is in the form of a conduit 218*a*,218*b*,218*c*,218*d*,218*e* having a depth and a height.

In this embodiment, the conduit 218*a*,218*b*,218*c*,218*d*, 218*e* is substantially non-circular in cross-section, and has a depth/height aspect ratio in the range of 0.4-1.2, and typically in the range of 0.6-1.

In an alternative embodiment, the conduit 218*a*,218*b*, 218*c*,218*d*,218*e* may be substantially circular in cross-section.

The pump 200 comprises a first end or feed pump unit 205*a* and a second end or discharge pump unit 205*e*.

In this embodiment, the pump 200 further comprises three intermediate pump units 205*b*,205*c*,205*d*.

Conveniently, the inlet channel 230*a* of the first end or feed pump unit 205*a* is connected to a fluid supply.

The outlet channel 240*a* of the first end or feed pump unit 205*a* is connected to the inlet channel 230*b* of adjacent intermediate pump unit 205*b*.

The outlet channel 240*b* of intermediate pump unit 205*b* is connected to the inlet channel 230*c* of adjacent intermediate pump unit 205*c*.

The outlet channel 240*c* of intermediate pump unit 205*c* is connected to the inlet channel 230*d* of adjacent intermediate pump unit 205*d*.

The outlet channel 240*d* of intermediate pump unit 205*d* is connected to the inlet channel 230*e* of adjacent second end or discharge pump unit 205*e*.

Conveniently, the outlet channel 240*e* of the second end or discharge pump unit 205*e* is connected to a fluid discharge system.

Conveniently, the connection between the inlet channel 230*a*,230*b*,230*c*,230*d*,230*e* of a pump unit and an outlet channel 240*a*,240*b*,240*c*,240*d*,240*e* of an adjacent pump unit may be provided through their respective first or axial portions 234*a*,234*b*,234*c*,234*d*,234*e*, 244*a*, 244*b*, 244*c*, 244*d*, 244*e*.

Advantageously, the first or axial portions 234*a*,234*b*, 234*c*,234*d*,234*e*, 244*a*,244*b*,244*c*,244*d*,244*e* of the inlet 230*a*,230*b*,230*c*,230*d*,230*e* and outlet channels 240*a*,240*b*, 240*c*,240*d*,240*e* of the pump units 205*a*,205*b*,205*c*,205*d*, 205*e* are substantially parallel to the axis of rotation of the impellers 220*a*,220*b*,220*c*,220*d*,220*e* and share a common axis substantially parallel to the axis of rotation of the impellers 220*a*,220*b*,220*c*,220*d*,220*e*.

Advantageously, the pump units 205*a*,205*b*,205*c*,205*d*, 205*e* share a common centreline, e.g., the impellers 220*a*, 220*b*,220*c*,220*d*,220*e* share a common axis of rotation. By such provision, the pump units 205*a*,205*b*,205*c*,205*d*,205*e* are configured to optimise the compactness of the pump 200.

Advantageously, the impellers 220*a*,220*b*,220*c*,220*d*, 220*e* are connected to a drive shaft 260.

Conveniently, the drive shaft 260 and the impellers 220*a*, 220*b*,220*c*,220*d*,220*e* share a common axis of rotation.

Typically, the diameter of the shaft 260 is in the range of 10-90% of the diameter of an impeller hub portion 222*a*, 222*b*,222*c*,222*d*,222*e*. The diameter of the shaft 260 relative to the diameter of the hub portion 222*a*,222*b*,222*c*,222*d*, 222*e* may be selected to suit each particular application envisaged for the pump 200.

In this embodiment, the casing 210 comprises six casing units 210*a*,210*b*,210*c*,210*d*,210*e*,210*f*.

In an alternative embodiment, the casing 210 may comprise a single casing unit.

Each of the casing units 210*a*,210*b*,210*c*,210*d*,210*e*,210*f* comprises a first side facing toward a feed end of the pump, and a second side facing toward a discharge end of the pump.

The casing 210 comprises a first end or feed casing unit 210*a* and a second end or discharge casing unit 210*f*.

In this embodiment, the casing 210 further comprises four intermediate casing units 210*b*,210*c*,210*d*,210*e*.

In this embodiment, the first side of the first end or feed casing unit 210*a* is substantially solid and planar, and comprises an aperture 250 connected to the inlet channel 230*a* of the first end or feed casing unit 210*a*.

The second side of the first end or feed casing unit 210*a* is sealably connected to and in abutment with the first side of adjacent intermediate casing unit 210*b*.

The second side of intermediate casing unit 210*b* is sealably connected to and in abutment with the first side of adjacent intermediate casing unit 210*c*.

The second side of intermediate casing unit 210*c* is sealably connected to and in abutment with the first second side of adjacent intermediate casing unit 210*d*.

The second side of intermediate casing unit 210*d* is sealably connected to and in abutment with the first side of adjacent intermediate casing unit 210*e*.

The second side of intermediate casing unit 210*e* is sealably connected to and in abutment with the first side of second end or discharge casing unit 210*f*.

In this embodiment, the second side of the second end or discharge casing unit 210*f* is substantially solid and planar, and comprises an aperture 251 connected to the outlet channel 240*a* of the second end or discharge casing unit 210*f*.

Conveniently, the pump 210 is formed by providing an impeller 220*a*,220*b*,220*c*,220*d*,220*e* between the first side of a casing unit 210*b*,210*c*,210*d*,210*e*,210*f* and the second side of respectively adjacent casing unit 210*a*,210*b*,210*c*,210*d*, 210*e*.

In this embodiment, the first side of a casing unit 210*b*, 210*c*,210*d*,210*e*,210*f* and the second side of a respectively adjacent casing unit 210*a*,210*b*,210*c*,210*d*,210*e* are axially sealably connected by connection means such as screws or bolts (not shown) provided within holes or recesses 219.

Advantageously, the first side of a casing unit 210*b*,210*c*, 210*d*,210*e*,210*f* and the second side of a respectively adjacent casing unit 210*a*,210*b*,210*c*,210*d*,210*e* complement one another so as to form the fluid passage channels 215*a*, 215*b*,215*c*,215*d*,215*e* of the corresponding pump units 205*a*,205*b*,205*c*,205*d*,205*e*.

Advantageously also, the first side of a casing unit 210*b*, 210*c*,210*d*,210*e*,210*f* and the second side of a respectively adjacent casing unit 210*a*,210*b*,210*c*,210*d*,210*e* complement one another so as to form the second portions 232*a*, 232*b*,232*c*,232*d*,232*e*, 242*a*,242*b*,242*c*,242*d*,242*e* of the inlet channels 230*a*,230*b*,230*c*,230*d*,230*e* and outlet channels 240*a*,240*b*,240*c*,240*d*,240*e* of the corresponding pump unit 205*a*,205*b*,205*c*,205*d*,205*e*.

In this embodiment, the curved portions 236*a*,236*b*,236*c*, 236*d*,236*e*,246*a*,246*b*,246*c*,246*d*,246*e* of the inlet channels 230*a*,230*b*,230*c*,230*d*,230*e* and outlet channels 240*a*,240*b*, 240*c*,240*d*,240*e* are provided within the casing units 210*a*, 210*b*,210*c*,210*d*,210*e*,210*f*.

In this embodiment, the first or axial portions 234*a*,234*b*, 234*c*,234*d*,234*e*, 244*a*,244*b*,244*c*,244*d*,244*e* of the inlet channels 230*a*,230*b*,230*c*,230*d*,230*e* and outlet channels

240*a*,240*b*,240*c*,240*d*,240*e* are provided within the casing units 210*a*,210*b*,210*c*,210*d*,210*e*,210*f*.

The casing units 210*a*,210*b*,210*c*,210*d*,210*e*,210*f* have a diameter in the range of 20-1,500 mm, and typically in the range of 50-500 mm.

The casing units 210*a*,210*b*,210*c*,210*d*,210*e*,210*f* have a height in the range of 10-1000 mm, and typically in the range of 50-500 mm.

Advantageously, the impellers 220*a*,220*b*,220*c*,220*d*, 220*e* are capable of rotating clockwise and/or counter-clockwise.

Preferably, the impellers 220*a*,220*b*,220*c*,220*d*,220*e* are capable of being rotated clockwise and counter-clockwise. By such provision the multistage pump 200 may be used in a first or normal fluid direction and in a second or reverse fluid direction. This allows a user to reverse the direction in which a fluid is being pumped as required.

In an alternative embodiment (not shown), there is described a regenerative pump 200' according to a second embodiment of a second aspect of the present invention. The pump 200' is a 'multistage' regenerative pump of generally similar design to the pump 200 of FIGS. 1 to 8, like parts being denoted by like numerals, incremented by "'". However, in this embodiment, each of the plurality of pump units 205*a*',205*b*',205*c*',205*d*',205*e*' is of a generally similar design to the pump unit 105' described in FIG. 9.

Each of the pump units 205*a*',205*b*',205*c*',205*d*',205*e*' comprises a casing, each comprising a fluid passage channel 215*a*',215*b*',215*c*',215*d*',215*e*'.

Each of the pump units 205*a*',205*b*',205*c*',205*d*',205*e*' further comprises a impeller 220*a*',220*b*',220*c*',220*d*',220*e*' provided respectively inside the casing for pumping the fluid through the fluid passage channel 215*a*',215*b*',215*c*',215*d*', 215*e*'.

In this embodiment, each casing respectively comprises an inlet channel 230*a*',230*b*',230'*c*,230*d*',230*e*' and an outlet channel 240*a*',240*b*',240*c*',240*d*',240*e*'.

Each of the inlet channels 230*a*',230*b*',230'*c*,230*d*',230*e*' respectively comprises a first or axial portion 234*a*',234*b*', 234*c*',234*d*',234*e*' which extends from the fluid passage channel 215*a*',215*b*',215*c*',215*d*',215*e*' substantially parallel to an axis of rotation of the impeller 220*a*',220*b*',220*c*',220*d*', 220*e*' and/or substantially perpendicular to a plane containing the fluid passage channel 215*a*',215*b*',215*c*',215*d*',215*e*'. Each of the outlet channels 240*a*',240*b*',240*c*',240*d*',240*e*' respectively comprises a first or axial portion 244*a*',244*b*', 244*c*',244*d*',244*e*' which extends from the fluid passage channel 215*a*',215*b*',215*c*',215*d*',215*e*' substantially parallel to an axis of rotation of the impeller 220*a*',220*b*',220*c*',220*d*', 220*e*' and/or substantially perpendicular to a plane containing the fluid passage channel 215*a*',215*b*',215*c*',215*d*',215*e*'.

Advantageously, the pump units 205*a*',205*b*',205*c*',205*d*', 205*e*' share a common centreline, e.g., the impellers 220*a*', 220*b*',220*c*',220*d*',220*e*' share a common axis of rotation. By such provision, the pump units 205*a*',205*b*',205*c*',205*d*', 205*e*' are configured to optimise the compactness of the pump 200'.

In an embodiment, the connection between the inlet channel 230*a*',230*b*',230'*c*,230*d*',230*e*' of a pump unit and an outlet channel 240*a*',240*b*',240*c*',240*d*',240*e*' of an adjacent pump unit is provided through their respective first or axial portions 234*a*',234*b*',234*c*',234*d*',234*e*',244*a*',244*b*',244*c*', 244*d*',244*e*'. In such embodiment, the first or axial portions 234*a*',234*b*',234*c*',234*d*',234*e*',244*a*',244*b*',244*c*',244*d*',244*e*' are provided at an angle relative to the axis of rotation of the impellers 220*a*',220*b*',220*c*',220*d*',220*e*'.

In an alternative embodiment, the connection between the inlet channel 230*a*',230*b*',230'*c*,230*d*',230*e*' of a pump unit and an outlet channel 240*a*',240*b*',240*c*',240*d*',240*e*' of an adjacent pump unit is provided through a connection portion connecting the first or axial portion 234*a*',234*b*',234*c*',234*d*', 234*e*' of an inlet channel 230*a*',230*b*',230'*c*,230*d*',230*e*' of a pump unit and an the first or axial portion 244*a*',244*b*',244*c*', 244*d*',244*e*' outlet channel 240*a*',240*b*',240*c*',240*d*',240*e*' of an adjacent pump unit. The connecting portions may be curved, or alternatively may extend at an angle relative to the axis of rotation of the impellers 220*a*',220*b*',220*c*',220*d*', 220*e*'.

Figure 14A:
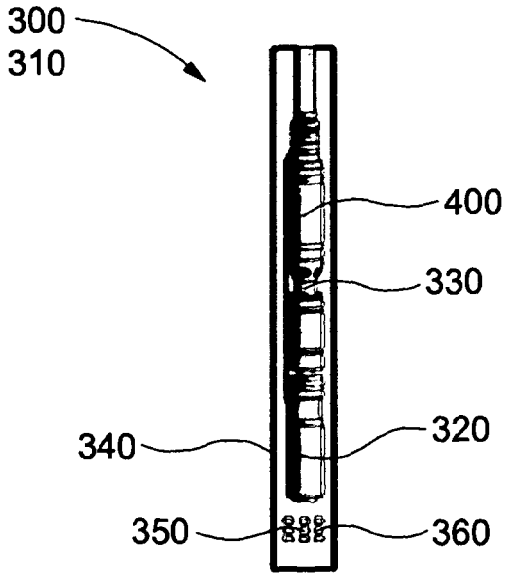
FIG. 14*a* an elevated front view of an artificial lift system according to a first embodiment of a fifth aspect of the present invention.
Figure 14B:
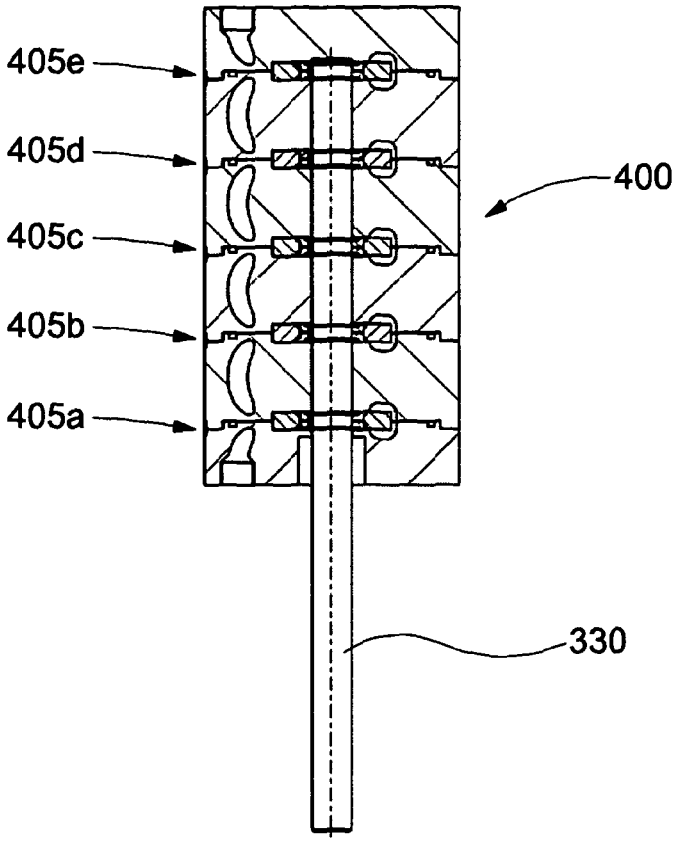
FIG. 14*b* a cross-sectional view of the pump used in the artificial lift system of FIG. 14*a;*

Referring to FIGS. 14*a* and 14*b* there is shown an Artificial Lift System (ALS) 300 according to a first embodiment of a fifth aspect of the present invention comprising a multistage regenerative pump 400.

The pump 400 comprises a pump 200 according to the first embodiment of the second aspect of the invention, like parts being denoted by like numerals, but supplemented by '200'.

Typically, the artificial lift system 300 comprise an Electrical Submersible Pump (ESP) 310 for insertion into an oil well or downhole.

Typically, the pump 400 is driven by a motor 320 through a drive shaft 330.

The motor 320 is electrically operated, and connected to a power supply such as surface power supply (not shown) by connecting means, e.g. electrical wiring or cables.

The artificial lift system 300 is provided within a casing 340. The casing is provided with a supply portion 350 for allowing a downhole fluid inside the casing 340.

The artificial lift system 300 is further equipped with filtering and/or straining means 360 for removing at least some particulate matters from the fluid to be pumped.

Typically, the fluid to be pumped comprises a natural fluid such as a fossil fuel fluid, e.g. oil or natural gas.

Typically, the pressure rise ratio between an outlet of and an inlet of each pump unit 405*a*,405*b*,405*c*,405*d*,405*e* is in the range of 1-100, and typically in the range of 1-10.

Typically, the incremental gain in fluid pressure provided by each pump unit 405*a*,405*b*,405*c*,405*d*,405*e* is in the range of 20-200 psi, and typically in the range of 50-100 psi, when the pump 200 is used for pumping oil.

Typically, the operative rotational speed of the pump 200 is in the range of 500-25,000 rpm, and typically in the range of 3,000-20,000 rpm.

Figure 15A:
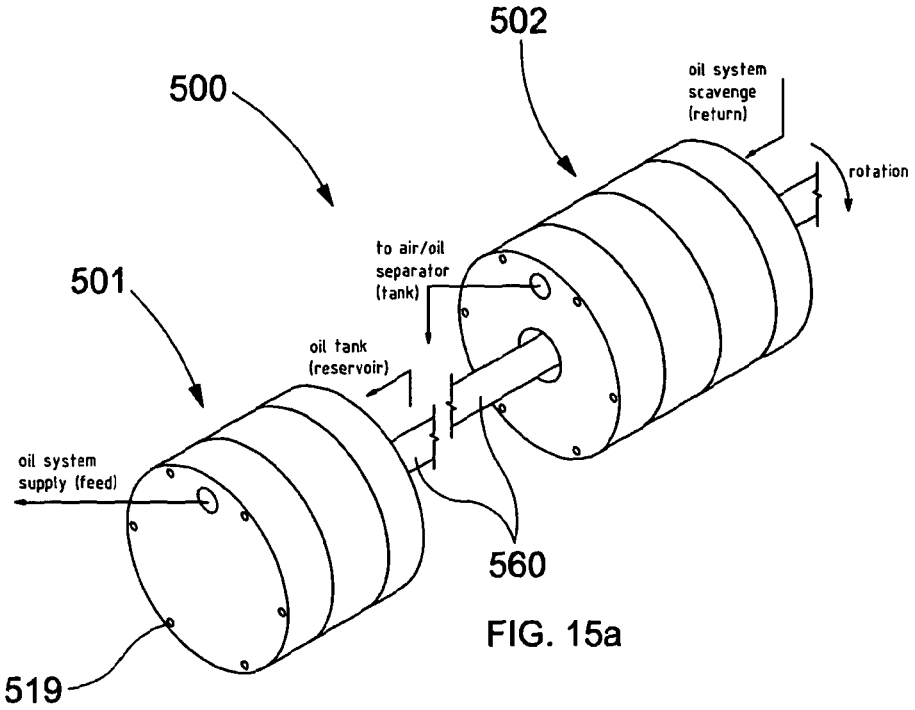
FIG. 15*a* a perspective view of a gas turbine engine oil pump according to a first embodiment of a sixth aspect of the present invention.
Figure 15B:
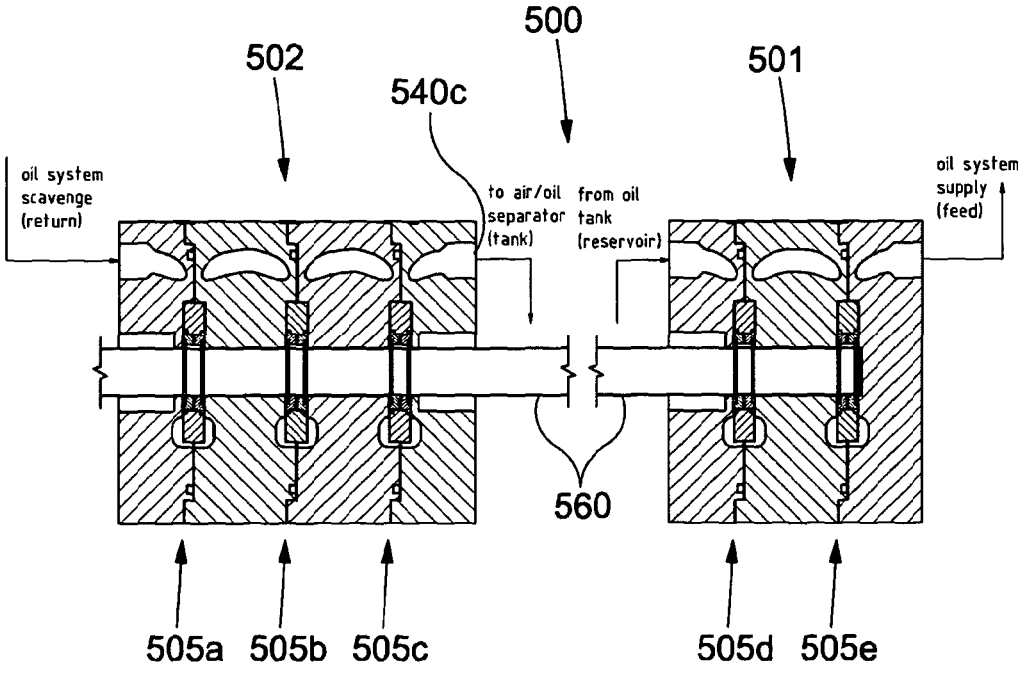
FIG. 15*b* a cross-sectional view of the pump of FIG. 15*a;*

Referring to FIGS. 15*a* and 15*b* there is shown an oil pump 500 for a gas turbine engine according to a first embodiment of a sixth aspect of the present invention.

Advantageously, the pump 500 comprises a pump 200 according to first embodiment of the second aspect of the invention, like parts being denoted by like numerals, but supplemented by '300'.

Preferably, the pump 500 comprises a feeding section 501 for pumping oil from an oil reservoir to the gas turbine engine.

In this embodiment, the feeding section 501 comprises 2 pump units 505*d*,505*e*.

Preferably, the pump 500 further comprises a scavenging section 502 for pumping oil from the gas turbine engine to an oil reservoir.

In this embodiment, the scavenging section 502 comprises 3 pump units 505*a*,505*b*,505*c*.

In this embodiment, the number of pump units 505*a*,505*b*, 505*c* in the scavenging section 502 is greater than the number of pump units 505*d*,505*e* in the feeding section 501.

In an alternative embodiment, the number of pump units 505*a*,505*b*,505*c* in the scavenging section 502 may be less than the number of pump units 505*d*,505*e* in the feeding section 501.

Advantageously, an outlet 540*c* of the scavenging section 502 is connected to a filter means (not shown), e.g. an air/oil separator, prior to the oil being discharged into the oil reservoir.

Conveniently, the feeding section 501 and scavenging section 502 are connected to and/or driven by a common shaft 560.

In this embodiment, the pump 500 is operated clockwise as viewed on FIG. 15*a*.

In an alternative embodiment, the pump 500 may be operated clockwise and/or counterclockwise depending on operating requirements.

Figure 16A:
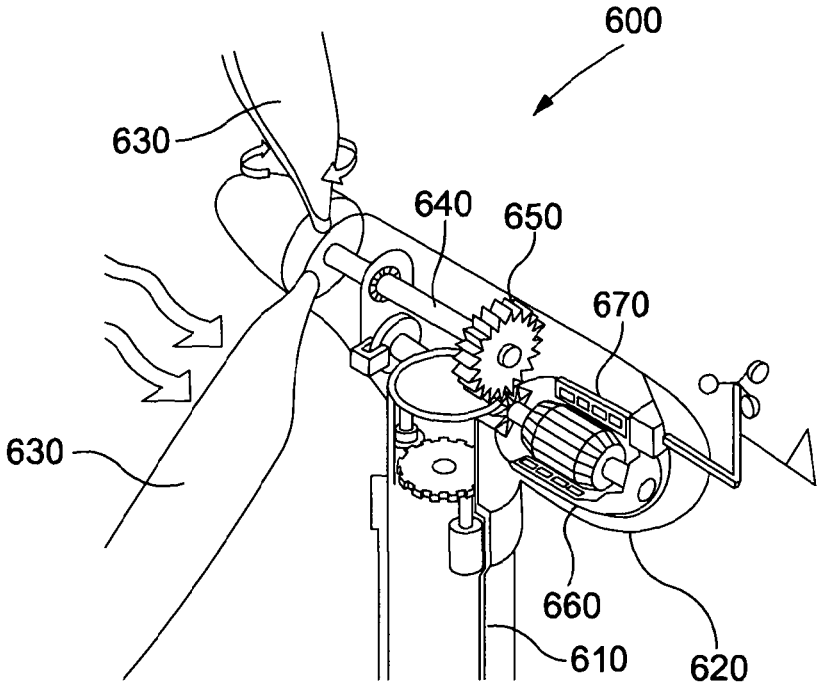
FIG. 16*a* a perspective view of a wind turbine comprising a gearbox lubrication pump according to a first embodiment of a seventh aspect of the present invention.
Figure 16B:
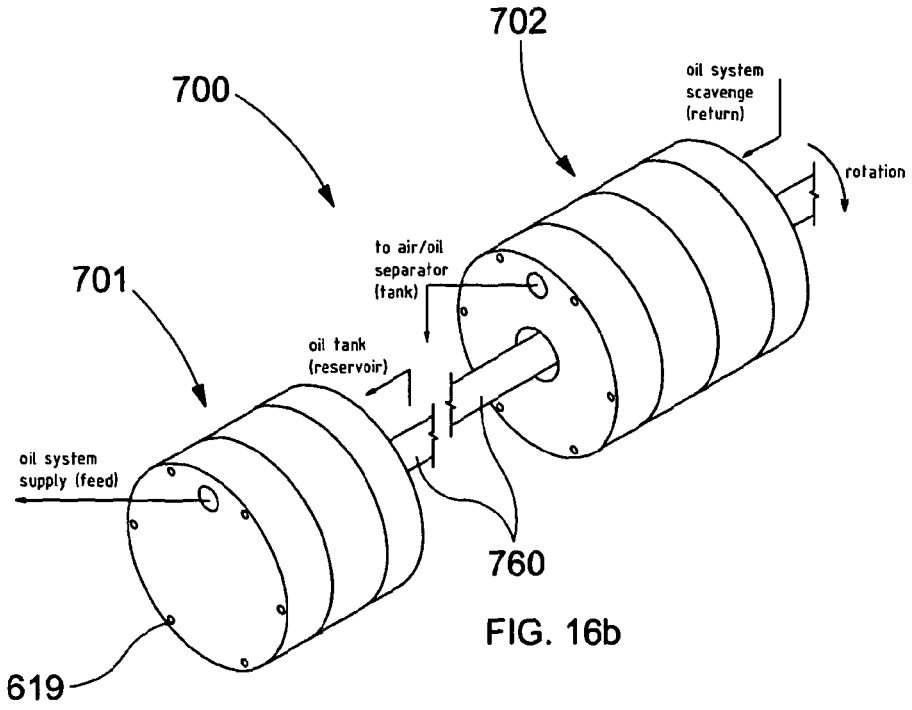
FIG. 16*b* a perspective view of the gearbox lubrication pump of FIG. 16*a*.
Figure 16C:
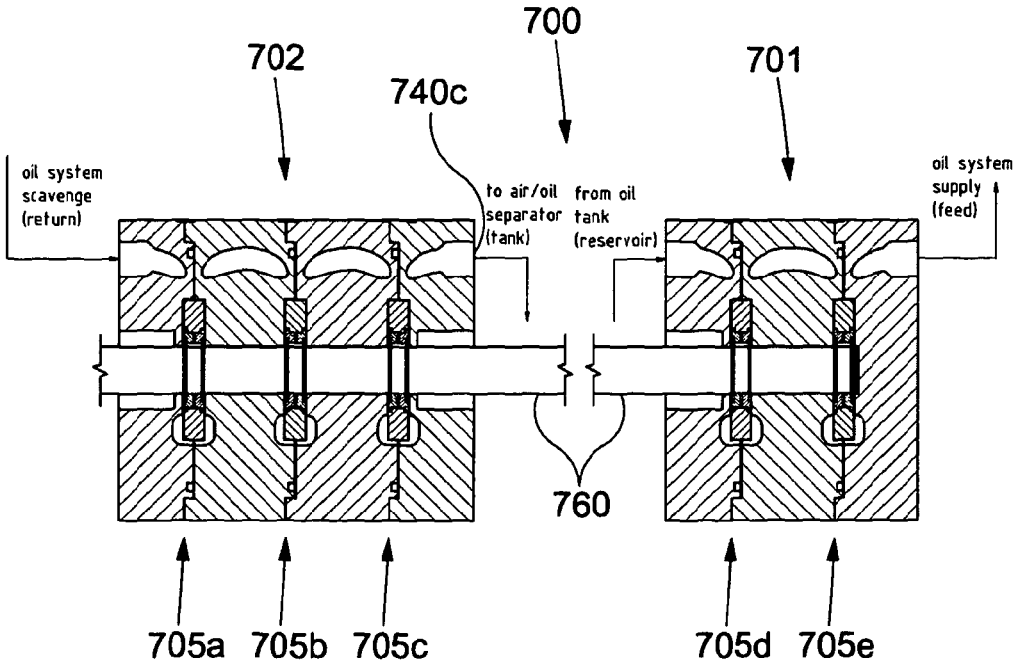
FIG. 16*c* a cross-sectional view of the pump of FIG. 16*b*.

Referring to FIGS. 16*a*, 16*b* and 16*c* there is shown an wind turbine 600 comprising a gearbox oil pump 700 according to a first embodiment of a seventh aspect of the present invention.

Referring to FIG. 16*a*, the wind turbine 600 comprises a tower 610 supporting a nacelle 620.

The wind turbine 600 comprises a plurality of blades 630 extending substantially radially from an end portion of the nacelle 620.

The blades 630 are mounted on an end portion of a low speed shaft 640 which is connected at an opposite end to a gear box 650.

The gear box 650 is connected to a high speed generator shaft 660 which in turns drives a generator 670.

Typically, the gear box 650 is continuously lubricated by a gearbox lubrication system (not shown).

Conventionally, the gearbox lubrication system is located within the nacelle 620 of the wind turbine 600.

Referring to FIGS. 16*b* and 16*c*, the gearbox lubrication system comprises a lubrication pump 700.

The lubrication pump 700 comprises a pump 200 according to first embodiment of the second aspect of the invention, like parts being denoted by like numerals, but supplemented by '500'.

Preferably, the pump 700 comprises a feeding section 701 for pumping oil from an oil reservoir to the gearbox lubrication system.

In this embodiment, the feeding section 701 comprises 2 pump units 705*d*,705*e*.

Preferably, the pump 700 further comprises a scavenging section 702 for pumping oil from the gas turbine engine to an oil reservoir.

In this embodiment, the scavenging section 702 comprises 3 pump units 705*a*,705*b*,705*c*.

In this embodiment, the number of pump units 705*a*,705*b*, 705*c* in the scavenging section 702 is greater than the number of pump units 705*d*,705*e* in the feeding section 701.

In an alternative embodiment, the number of pump units 705*a*,705*b*,705*c* in the scavenging section 702 may be less than the number of pump units 705*d*,705*e* in the feeding section 701.

Advantageously, an outlet 740*c* of the scavenging section 702 is connected to a filter means (not shown), e.g. an air/oil separator, prior to the oil being discharged into the oil reservoir.

Conveniently, the feeding section 701 and scavenging section 702 are connected to and/or driven by a common shaft 760.

In this embodiment, the pump 700 is operated clockwise as viewed on FIG. 15*b*.

In an alternative embodiment, the pump 700 may be operated clockwise and/or counterclockwise depending on operating requirements.

The invention claimed is:

1. A regenerative pump comprising a plurality of pump units, each of the plurality of pump units comprising a housing comprising a fluid passage channel; and at least one impeller provided inside the casing or housing for pumping the fluid through the fluid passage channel, wherein the housing comprises at least one inlet channel and at least one outlet channel in communication with the fluid passage channel, wherein the plurality of pump units comprises a feed pump unit, a discharge pump unit, and one or more intermediate pump units, and wherein at least the outlet channel of the feed pump unit, both the inlet channel and the outlet channel of each intermediate pump unit, and at least the inlet channel of the discharge pump unit each comprise an axial portion at least partially parallel to an axis of rotation of the at least one impeller, the axial portions being at least partially aligned and sharing a common axis substantially parallel to the axis of rotation of the at least one impeller.

2. A pump according to claim 1, wherein the at least one inlet channel and/or the at least one outlet channel is peripheral to the fluid passage channel and/or the casing or housing.

3. A pump according to claim 1, wherein the at least one inlet channel and/or the at least one outlet channel comprises a second portion extending from the fluid passage channel in a plane at least partially perpendicular to an axis of rotation of the impeller.

4. A pump according to claim 3, wherein the second portion extends from the fluid passage channel in a direction not passing through an axis of rotation of the at least one impeller, and/or wherein the second portion extends from the fluid passage channel in a direction substantially tangential to a continuous fluid flow between the second portion and the fluid passage channel.

5. A pump according to claim 3, wherein the axial portion and the second portion of the at least one inlet and/or outlet channel are in communication with one another and/or are connected by at least one curved portion.

6. A pump according to claim 1, wherein the inlet channel of the feed pump unit and/or the outlet channel discharge pump unit comprises an axial portion substantially parallel to an axis of rotation of the at least one impeller.

7. A pump according to claim 1, wherein the inlet channel of the feed pump unit and/or the outlet channel of the second end or discharge pump unit extends from the fluid passage channel in a plane at least partially perpendicular to an axis of rotation of the impeller.

8. A pump according to claim 1, wherein the connection between an inlet channel of a pump unit and an outlet channel of an adjacent pump unit is provided through their respective first or axial portions.

9. A pump according to claim 1, wherein the at least one impeller is capable of being rotated clockwise and counterclockwise.

10. A regenerative pump comprising a pump unit, the pump unit comprising a casing or housing comprising a fluid passage channel; and an impeller provided inside the casing for pumping the fluid through the fluid passage channel, wherein the casing or housing comprises at least one inlet channel in communication with the fluid passage channel, the inlet channel and the outlet channel each comprising an axial portion at least partially parallel to an axis of rotation of the impeller, wherein the casing comprises a feed casing unit and a discharge casing unit, wherein the feed casing unit and the discharge casing unit each comprise a first side facing toward a feed end of the pump and a second side facing toward a discharge end of the pump, wherein the first side of the feed casing unit is substantially solid and comprises an aperture connected to the inlet channel, wherein the second side of the discharge casing unit is substantially solid and comprises an aperture connected to the outlet channel, and wherein the second side of the feed casing unit is axially sealably connected to and in abutment with the first side of the discharge casing unit, and wherein the axial portions of the inlet channel and the outlet channel are at least partially aligned and share a common axis substantially parallel to the axis of rotation of the impeller.

11. A housing for use in a pump according to claim 1.

12. A wellbore, gas turbine engine oil pump, gearbox lubrication system, process manufacturing apparatus, water pump apparatus or fuel pump apparatus comprising at least one pump according to claim 1.

13. A wellbore, gas turbine engine oil pump, gearbox lubrication system, process manufacturing apparatus, water pump apparatus or fuel pump apparatus comprising at least one pump according to claim 10.

14. A casing for use in a pump according to claim 10.

15. The pump according to claim 10, wherein the first side of each of the feed casing unit and discharge casing unit is substantially planar.

16. The pump according to claim 10, wherein the axial portion of the inlet channel is provided within the feed casing unit, and wherein the axial portion of the outlet channel is provided within the discharge unit.

* * * * *